US011473321B2

(12) United States Patent
Bond

(10) Patent No.: US 11,473,321 B2
(45) **Date of Patent: *Oct. 18, 2022**

(54) MAIN BEAM STRUCTURE AND PROFILE FOR FORMWORK GRID SYSTEMS

(71) Applicant: Bond Formwork Systems, LLC, Waller, TX (US)

(72) Inventor: Bradley D. A. Bond, Waller, TX (US)

(73) Assignee: BOND FORMWORK SYSTEMS, LLC, Waller, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/325,335

(22) Filed: May 20, 2021

(65) Prior Publication Data

US 2022/0034105 A1 Feb. 3, 2022

Related U.S. Application Data

(63) Continuation of application No. 16/944,468, filed on Jul. 31, 2020, now Pat. No. 11,047,142.

(51) Int. Cl.
*E04G 11/50* (2006.01)

(52) U.S. Cl.
CPC ..... *E04G 11/50* (2013.01)

(58) Field of Classification Search
CPC ..... E04G 11/38; E04G 11/48; E04G 11/483; E04G 11/486; E04G 11/50; E04G 11/52; E04G 2011/505
See application file for complete search history.

(56) References Cited

U.S. PATENT DOCUMENTS 2,010,848 A 8/1935 Dix
3,016,116 A 1/1962 Clevenger
(Continued)

FOREIGN PATENT DOCUMENTS

CA 2698537 A1 3/2008
CN 102797353 11/2012
(Continued)

OTHER PUBLICATIONS

DIN EN ISO 9001, "Slab forming system ISCHEBECK HV" brochure, USA/HV/LI/11.2009, 12 pages.
(Continued)

*Primary Examiner* — Michael Safavi
(74) *Attorney, Agent, or Firm* — Nolte Lackenback Siegel

(57) ABSTRACT

A main beam for a formwork grid construction component system is disclosed. Typical main beams work with secondary joists (sometimes referred to as secondary beams to support a decking surface for pouring of concrete or cement. By strengthening the main beam using an altered profile while maintaining interoperable external dimensions, the span distance of each joist may be increased. By forming the main beam with the disclosed profile, joists can be made longer (e.g., have an eight foot connected span to increase grid size) and maintain appropriate strength (or increased weight tolerance). Formwork grid systems are used in construction of buildings and other structures. Interoperability with existing components is maintained by the disclosed main beam adhering to the same external functional form factor. The external form factor being the same allows main beams constructed in accordance with this disclosure to properly function with existing formwork grid construction components.

18 Claims, 24 Drawing Sheets

(56) References Cited

U.S. PATENT DOCUMENTS

| | | | | |
|---|---|---|---|---|
| 3,037,590 | A | 6/1962 | Pavalecka | |
| 3,108,663 | A * | 10/1963 | Glaser | B21C 23/14 52/632 |
| 3,176,807 | A | 4/1965 | Pavalecka | |
| 3,184,013 | A | 5/1965 | Pavalecka | |
| 3,409,266 | A | 11/1968 | Jennings | |
| 3,562,970 | A | 2/1971 | Schwartz | |
| 3,668,827 | A | 6/1972 | Schwartz | |
| 3,862,530 | A | 1/1975 | Martine | |
| 3,917,214 | A * | 11/1975 | Ratcliff | E04G 11/50 249/18 |
| 4,034,957 | A | 7/1977 | Cody | |
| 4,156,999 | A | 7/1979 | Avery | |
| 4,159,604 | A | 7/1979 | Burrell | |
| 4,333,289 | A | 6/1982 | Strickland | |
| 4,441,300 | A | 4/1984 | Varon | |
| 4,492,358 | A | 1/1985 | Manderla | |
| 4,679,007 | A | 7/1987 | Reese et al. | |
| 3,026,977 | A | 3/1992 | Pollock | |
| 5,175,472 | A | 12/1992 | Johnson, Jr. et al. | |
| 5,195,045 | A | 3/1993 | Keane et al. | |
| 5,233,807 | A | 8/1993 | Spera | |
| 5,307,596 | A | 5/1994 | Bockmiller | |
| 5,394,061 | A | 2/1995 | Fujii | |
| 5,579,624 | A | 12/1996 | Aeberhard | |
| 5,743,058 | A | 4/1998 | Boomsma | |
| 5,996,299 | A | 12/1999 | Hsueh | |
| 6,209,275 | B1 | 4/2001 | Cates | |
| 6,260,321 | B1 | 7/2001 | Rudduck | |
| 7,578,110 | B2 | 8/2009 | Jenkins | |
| 8,262,056 | B2 | 9/2012 | Schwoerer | |
| 8,307,607 | B2 | 11/2012 | Conterno | |
| 8,616,519 | B2 | 12/2013 | Bacon | |
| 8,820,018 | B2 | 9/2014 | Maley | |
| 9,004,443 | B2 | 4/2015 | Zhang | |
| 10,024,069 | B2 | 7/2018 | Bond et al. | |
| 10,053,875 | B1 | 8/2018 | Baron | |
| 10,053,877 | B2 | 8/2018 | Lenkin | |
| 10,590,665 | B2 | 3/2020 | Lenkin | |
| 10,711,472 | B2 | 7/2020 | Bond | |
| 2011/0168868 | A1* | 7/2011 | Xammar Bove | E04G 11/50 249/50 |
| 2014/0263941 | A1 | 9/2014 | Zhang | |
| 2016/0060882 | A1 | 3/2016 | Bond | |
| 2018/0080238 | A1* | 3/2018 | Lenkin | E04B 5/02 |
| 2018/0187437 | A1 | 7/2018 | Chevis | |
| 2018/0258657 | A1 | 9/2018 | Chevis | |
| 2018/0340342 | A1 | 11/2018 | Lizarazu et al. | |
| 2019/0010716 | A1 | 1/2019 | Baron | |
| 2019/0127996 | A1 | 5/2019 | Chevis | |
| 2019/0145115 | A1 | 5/2019 | Bacon | |
| 2019/0194961 | A1 | 6/2019 | Bond | |
| 2020/0102764 | A1 | 4/2020 | Bacon | |

FOREIGN PATENT DOCUMENTS

| | | | | |
|---|---|---|---|---|
| CN | 108868126 | A | 11/2018 | |
| DE | 2927116 | A1 | 8/1981 | |
| DE | 3147081 | A1 | 12/1982 | |
| DE | 3316557 | C1 | 11/1984 | |
| DE | 3921065 | C1 * | 10/1990 | E04G 11/56 |
| DE | 3921064 | A1 * | 1/1991 | E04G 11/50 |
| DE | 4204773 | A1 | 8/1993 | |
| DE | 20201800307 | U1 | 3/2018 | |
| EP | 0345902 | A2 * | 12/1989 | E04G 11/486 |
| EP | 0380149 | A1 * | 8/1990 | E04G 11/486 |
| EP | 0430351 | A1 * | 6/1991 | E04G 11/486 |
| EP | 0511921 | A1 * | 11/1992 | E04G 11/486 |
| EP | 1847665 | | 10/2007 | |
| EP | 1847665 | A1 * | 10/2007 | E04G 11/00 |
| EP | 2749713 | A1 | 7/2014 | |
| EP | 3202998 | A1 | 8/2017 | |
| FR | 2508958 | A1 | 7/1982 | |
| FR | 2689543 | A1 * | 10/1993 | E04G 11/486 |
| FR | 2821104 | A1 * | 8/2002 | E04G 11/50 |
| FR | 2497862 | A1 | 10/2007 | |
| FR | 2900176 | A1 | 10/2007 | |
| FR | 2916466 | A1 | 11/2008 | |
| FR | 2923241 | A1 * | 5/2009 | E04G 11/50 |
| FR | 2923241 | A1 | 5/2009 | |
| FR | 2977610 | A1 * | 1/2013 | E04G 11/50 |
| FR | 3021985 | A1 | 12/2015 | |
| FR | 3021985 | B1 * | 5/2018 | E04G 11/38 |
| GB | 1457136 | | 3/1974 | |
| GB | 2090901 | | 7/1982 | |
| GB | 2099902 | | 12/1982 | |
| GB | 2054691 | | 2/1991 | |
| GB | 2265655 | * | 10/1993 | E04G 11/50 |
| JP | 08042163 | A | 2/1996 | |
| KR | 20090076813 | A | 7/2009 | |
| KR | 22090076813 | A | 7/2009 | |
| WO | WO-02084050 | A1 * | 10/2002 | E04G 11/38 |
| WO | 2017134135 | A1 | 8/2017 | |
| WO | 2019156958 | A1 | 8/2019 | |
| WO | 2009009898 | A1 | 1/2020 | |
| WO | 2020083935 | A1 | 4/2020 | |

OTHER PUBLICATIONS

TITAN HV Slab Forming System, Concrete Support Systems www.concretesupportusa.com, Oct. 2010 74 pages.

* cited by examiner

MAIN BEAM STRUCTURE AND PROFILE FOR FORMWORK GRID SYSTEMS

CROSS REFERENCE TO RELATED APPLICATIONS

This Application is a continuation application of, incorporates by reference, and claims priority to copending U.S. patent application Ser. No. 16/944,468 having the same inventorship and title as the instant application. This Application is related to concurrently filed Application for US Patent, entitled, "DROPHEAD NUT FOR FORMWORK GRID SYSTEMS," by Bradley Bond, having application Ser. No. 16/944,483, which is incorporated by reference herein for all applicable purposes. This Application is also related to concurrently filed Application for US Patent, entitled, "SECONDARY JOIST PROFILE FOR GRID SYSTEMS," by Bradley Bond, having application Ser. No. 16/944,473, which is incorporated by reference herein for all applicable purposes.

BACKGROUND

Formwork is a type of construction material used in the construction of buildings and other types of architectural projects that typically include concrete sections (e.g., walls, floors). Formwork may be temporary or permanent. Temporary formwork is the focus of this disclosure and differs from permanent formwork at least because temporary formwork is used during the construction process and does not become part of the completed structure (i.e., permanent). Formwork is generally used to assist in creating a "form" into which concrete, or cement may be poured and then allowed to "set" into a hardened material. One typical use for temporary formwork is to support different layers of a building while concrete, or cement floors are poured for each layer (e.g., floor of the building or structure).

In one example, formwork may be used to create a grid system to support a roof or ceiling of an already finished floor while the next higher floor is poured. The grid system includes support props (sometimes called "posts" or "shores") that hold main beams that are in turn spanned by joists (e.g., perpendicular to the main beams). The joists and main beams support a decking material (usually plywood but may be other materials such as plastic or metal) onto which cement may be poured and allowed to set. In this manner, a building may be constructed from the ground up, one floor at a time. As each layer is built, temporary formwork from a previous layer may be removed (after the cement has sufficiently cured) and relocated to a higher floor to repeat the process of building each layer for subsequent floors of the structure.

Currently available systems may sometimes have an eight foot joist that may not provide an interoperable form factor. Current systems are not known to provide an eight foot main beam. This disclosure presents multiple aspects to provide for an improved main beam formwork component that may be used in conjunction with improved joists to provide grid systems that are stronger, longer, more durable, and utilize less components to create larger grid patterns.

BRIEF DESCRIPTION OF THE DRAWINGS

The present disclosure may be better understood from the following detailed description when read with the accompanying Figures. It is emphasized that, in accordance with standard practice in the industry, various features are not drawn to scale (although in some cases, this disclosure attempts to maintain relative scale across different main beam profile views for comparison purposes as specifically stated below). In fact, the dimensions or locations of functional attributes may be relocated or combined based on design, structural requirements, building codes, or other factors known in the art of construction. Further, example usage of components may not represent an exhaustive list of how those components may be used alone, or with respect to each other. That is, some components may provide capabilities not specifically described in the examples of this disclosure but would be apparent and known to those of ordinary skill in the art, given the benefit of this disclosure. For a detailed description of various examples, reference be made below to the accompanying drawings, in which:

FIGS. 2A-1 to 2A-2 illustrate a grid system constructed of six foot main beams and six foot joists to illustrate multiple joist runs and other formwork components to construct a six by six grid of 23'-7 7/16" by 94'-5 7/8";

FIGS. 2B-1 to 2B-2 illustrate a comparable grid system, with respect to area, of that shown in FIGS. 2A-1 to 2A-2 that utilizes eight foot joists and form a six by eight grid, according to one or more disclosed implementations;

FIGS. 2C-1 to 2C-2 illustrate a comparable grid system, with respect to area, of that shown in FIGS. 2A-1 to 2A-2 that utilizes eight foot main beams and six foot joists to construct a six by eight grid, according to one or more disclosed implementations;

FIGS. 2D-1 to 2D-2 illustrate a comparable grid system, with respect to area, of that shown in FIGS. 2A-1 to 2A-2 that utilizes eight foot joists and eight foot main beams to form an eight by eight grid, according to one or more disclosed implementations;

DETAILED DESCRIPTION

Figure 1:
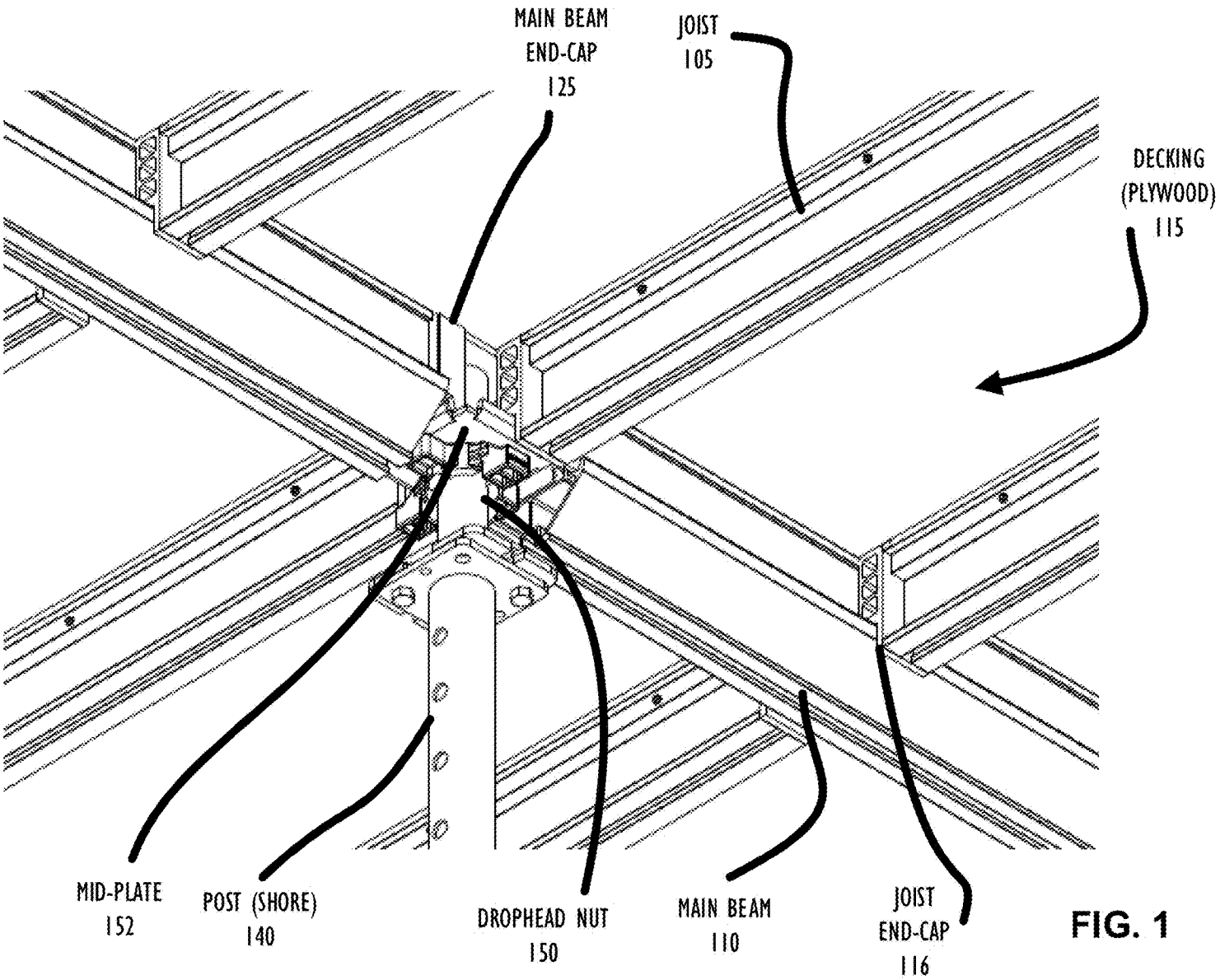
FIG. 1 illustrates a view from below the "pouring surface" that shows a connected set of formwork components for supporting a decking, according to one or more disclosed implementations.

Illustrative examples of the subject matter claimed below will now be disclosed. In the interest of clarity, not all features of an actual implementation are described for every example implementation in this specification. It will be appreciated that in the development of any such actual example, numerous implementation-specific decisions may be made to achieve the designers' specific goals, such as compliance with architectural and building code constraints, which will vary from one usage to another.

In this disclosure the terms "concrete" and "cement" are used interchangeably. Obviously, each of these materials may have different compositions and be used in different building situations. However, for the purposes of this disclosure, the characteristics of the building material and its ultimate supporting strength are not significant. Characteristics that are important for this disclosure include the fact that each of these materials starts out in a nearly liquid form that may be "poured" and then hardens (sometimes referred to as "setting") into a solid structure. The overall weight of the material when in liquid form is also significant for this disclosure because the disclosed formwork must be able to support a given thickness of the wet material while it proceeds through the curing process. Accordingly, usage of the term cement in an example is not to be considered limiting in any way and concrete may also be an option for that example.

In general, formwork is used to support portions of a building itself while the building is being constructed. Formwork may include multiple components that are modular. Each of the components provides specific capabilities and when used together with other formwork components may provide appropriate support characteristics as required for the building's construction parameters (e.g., thickness of slab, placement of permanent support columns). Formwork differs from scaffolding (another type of componentized construction material) in several ways. In particular, scaffolding is designed to provide safety and support for workers, equipment, and combinations thereof during a construction project. Simply put, if the installation is classified as scaffolding, entirely different standards apply than if the installation is classified as shoring (from formwork components). At least two issues, worker safety, and compliance with applicable standards, are involved in the distinction between scaffolding and formwork.

In contrast to scaffolding, formwork is designed to provide appropriate support characteristics for portions of the structure being built. Accordingly, the design specifications, requirements, and other characteristics of scaffolding differ greatly from those of formwork. For example, formwork will support orders of magnitude more weight than scaffolding and scaffolding may be designed to wrap the external facade of a building rather than be internal to the building. There are other differences between scaffolding and formwork that are known to those in the art.

The term "grid systems" generally refers to the set of components of formwork used to create a grid to support decking material such that concrete may be poured to form the floor immediately above the working area of the grid system. For example, a grid system on the ground floor (e.g., foundation) of a building would be installed on that ground floor to support pouring of concrete to create the floor of the second story of the building (or possibly the roof of a one-story building). Once the floor of the second story has cured, the grid system may be disassembled and relocated to the newly built floor to support pouring of the third story. This process may be repeated as many times as there are floors (i.e., stories) of the building.

Grid systems include, among other components, shores, or posts to provide vertical support, main beams to provide lateral support across the shores, and joists that span across main beams to provide support for a decking material. In formwork terminology, joists may be referred to as "secondary beams," "secondary joists," or some other term to distinguish them as the spanning support (above the main beams) for the sheathing or decking material. This disclosure provides information regarding an improved main beam that is stronger, lighter per unit length (i.e., lighter per foot of joist), and includes an altered main beam profile. The disclosed main beam remains compatible with existing grid systems, in part, because the main beam (and its profile) maintains external interoperable dimensions with respect to other components (e.g., has an "interoperable form factor").

The disclosed main beam profiles maintain a substantially similar height and width as previously available main beams to allow for an interoperable form factor and thus allow for interchangeable use with existing formwork components. Additionally, to further increase strength and allow for longer spans during use a stronger aluminum alloy and specifically reinforced portions (e.g., bottom areas, joints, thicker horizontal, vertical, and angle supports) of the profile are provided. The stronger profiles allow for increased main beam strength which, in turn, allows for longer joists. Together with improvements to the drophead nut these improvements allow for grids that are eight by eight and can support deeper slabs than previously available formwork components. Improvements to each of the drophead nut and joists are provided in detail in the above referenced related patent applications that have been incorporated by reference. Further, new profile designs allow for use of clips to allow flexibility in assembly that was not available in previous formwork grid systems. Specific test measurements for different example implementations are provided as an appendix to this Specification.

As used herein, the term "six foot main beam" refers to a main beam that is 1.7 m in actual length, which is slightly shorter than six feet. This length of main beam is typically referred to simply as a six foot main beam, because, when connected with additional formwork components, they may be used to create a grid that is almost six feet from center to center of the joists that are perpendicular to that main beam. That is, the additional distance, when measured center to center, is provided as part of the cross beams joining at another cross beam or at a drophead nut. Similarly, the term "eight foot main beam" refers to a main beam that is 2.3 m in actual length. This length of main beam is typically referred to as an eight foot main beam, because, when connected with additional formwork components, they may be used to great a grid that is almost eight feet from center to center of the joists that are perpendicular to that main beam. The terms "six foot joist" and "eight foot joist" are used in the same fashion, with respect to length, as the above defined "main beam" terms.

Referring now to FIG. 1, formwork grid system 100 illustrates several of the components discussed above configured to function together as an example of their use in construction. The view provided in FIG. 1 of formwork grid system 100 is from below and includes decking 115 that will most likely be plywood as the uppermost layer (decking 115 illustrated as background in FIG. 1 and would rest on top of, or be attached to, the top of the main beam 110 and joist 105 components. As mentioned above, a configured formwork grid system 100 would support pouring of wet cement onto the decking layer opposite and upper most side of decking 115 shown in FIG. 1. Once that cement has cured the formwork components shown in FIG. 1 may be removed (e.g., as part of reshoring). The removal process is sometimes called "stripping." After removal, it is likely that these components may be repositioned within the same structure (e.g., moved to another level) to be re-used to continue the layered building process.

As illustrated in FIG. 1, formwork grid system 100 includes a joist 105 that spans between two (or more) main beams 110 to support decking 115. As shown in FIG. 1, joists 105 and main beams 110 "join" or "connect" to a support post 140 via a drophead nut 150. Joists 105 may also join or connect to a main beam 110. Although shown engaged in the example of FIG. 1, joists 105 may also rest on top of and span across a set of main beams 110.

As illustrated, each joist 105 may include a joist end-cap 116 that would (if desired) align with a mid-plate lip (e.g., lip of mid-plate 152) or similar connection point on a main beam 110. This concept is illustrated here by main beam end-cap 125 which is shown "connected" to drophead nut 150 at a lip of mid-plate 152. Alternatively, as mentioned above, each joist 105 may simply overlap main beam 110. A combination of joists 105 and main beams 110 collectively work to support a platform of decking 115 (e.g., plywood). Although plywood is most commonly used for decking 115, other materials (e.g., metal, plastic) may be used to provide decking support.

FIG. 1 also illustrates post (shore) 140 that is directly below drophead nut 150. As explained above, the combination of post 140 with drophead nut 150 provides vertical support for each main beam 110 and/or joists 105. These beams in turn support decking 115. To remove formwork grid system 100 (after curing of the cement layer above decking 115), a rotational nut on drophead nut 150 would be spun (rotated) enough to align its retention pin gap (not visible) with a retention pin (not visible) of the drophead nut 150. As is understood in the art, rotation to disengage the rotational nut of drophead nut 150 may be performed by striking an impact surface of the rotational nut to effect rotation. Upon alignment of gaps in both the rotational nut and mid-plate 152 with the retention pin of a post in the center of drophead nut 150, drophead nut 150 would change from an engaged position to a collapsed position with mid-plate 152 and the rotational nut that are directly below mid-plate 152 (when engaged); dropping toward post 140 to release upward support on main beam 110 and allow for disassembly of formwork grid system 100.

The next few examples of this disclosure highlight that use of a longer joists and main beams (e.g., 8 foot versus 6 foot) may reduce an overall amount of formwork components needed to support an area of decking. The longer span allows for fewer parts (i.e., a lower number of formwork components to establish a given support structure) to be used. In some cases, the savings are as much as 25% to 40% (or more) with regard to the number of components. The reduction in amount of total formwork components provides many benefits. Specifically, the overall weight of components to transport to a job site is reduced (freight cost reduction), cost to rent or buy the components is reduced, the amount of time required to construct the formwork components is reduced (labor cost reduction), fewer components increase overall safety (less labor effort reduces potential for worker injury), and in general provides a more cost effective solution over prior art systems. In general, the ability to alter from a traditional six foot by six foot grid to either a six foot by eight foot grid, or an eight foot by eight foot grid allows a contractor increased flexibility in design to reduce the number of overall components used.

Additionally, longer joists and main beams allow for increased flexibility in contractor designs that may allow the contractor to miss more columns, walls, and pipes in the slab when creating the formwork grid system. In this disclosure, and in the industry, it is common to refer to a main beam as either a six foot main beam or an eight foot main beam which reflects the grid size built by that particular combination of main beam and joist. However, a six foot main beam is 1.70 meters in actual length (5'-6.9375") which is slightly shorter than six feet. As explained above, the additional span for the grid to have six or eight foot segments is realized by the width of the connection components between spanning grid components (e.g., main beams and joists). Examples of connection components that add the incremental amounts to result in equal grid sizes are drophead nuts, end-cap connections, etc., that are used to join components to form a longer span as discussed in FIGS. 2A-1 through 2D-2.

Figures 1, 2A:
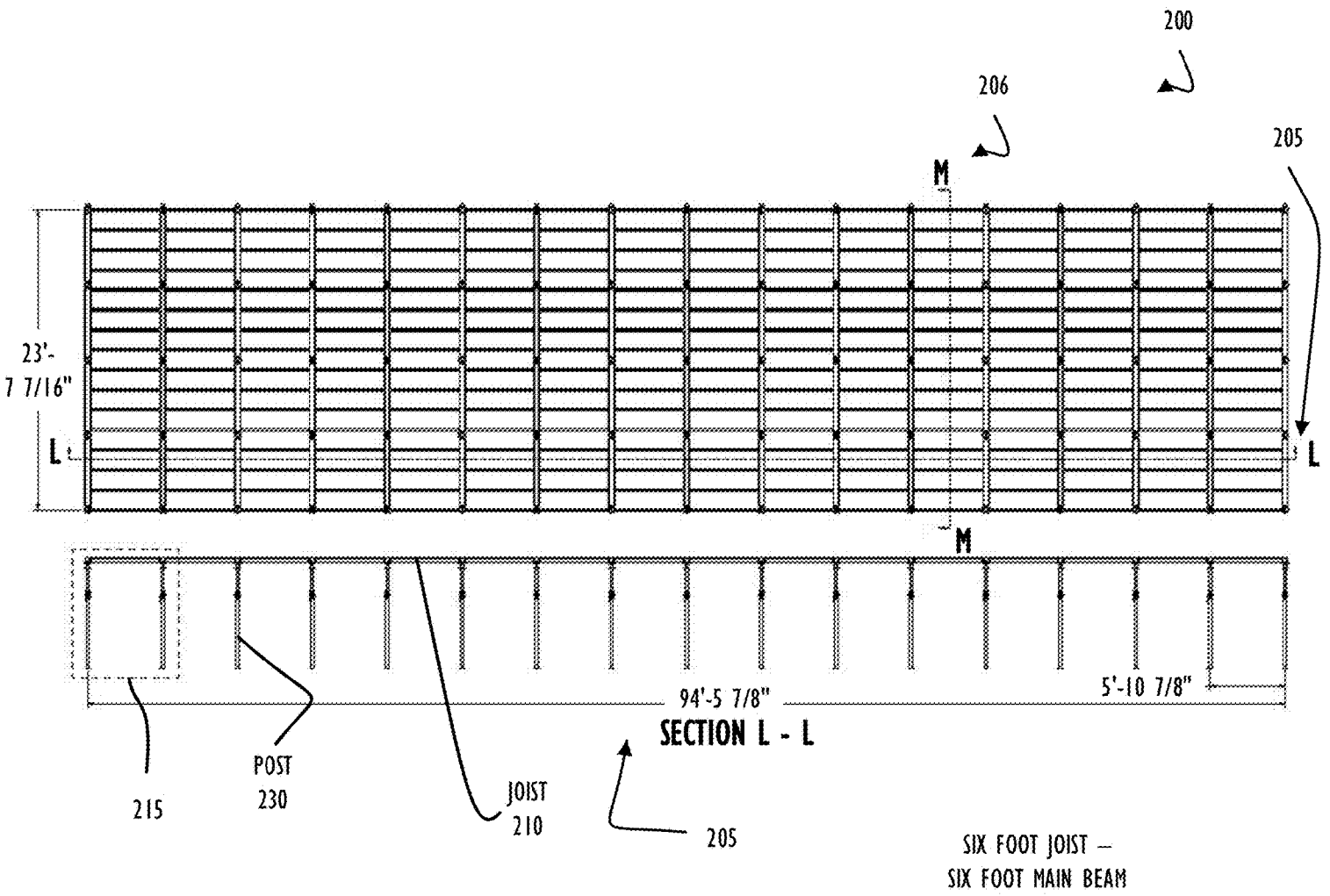
Figures 2, 2A:
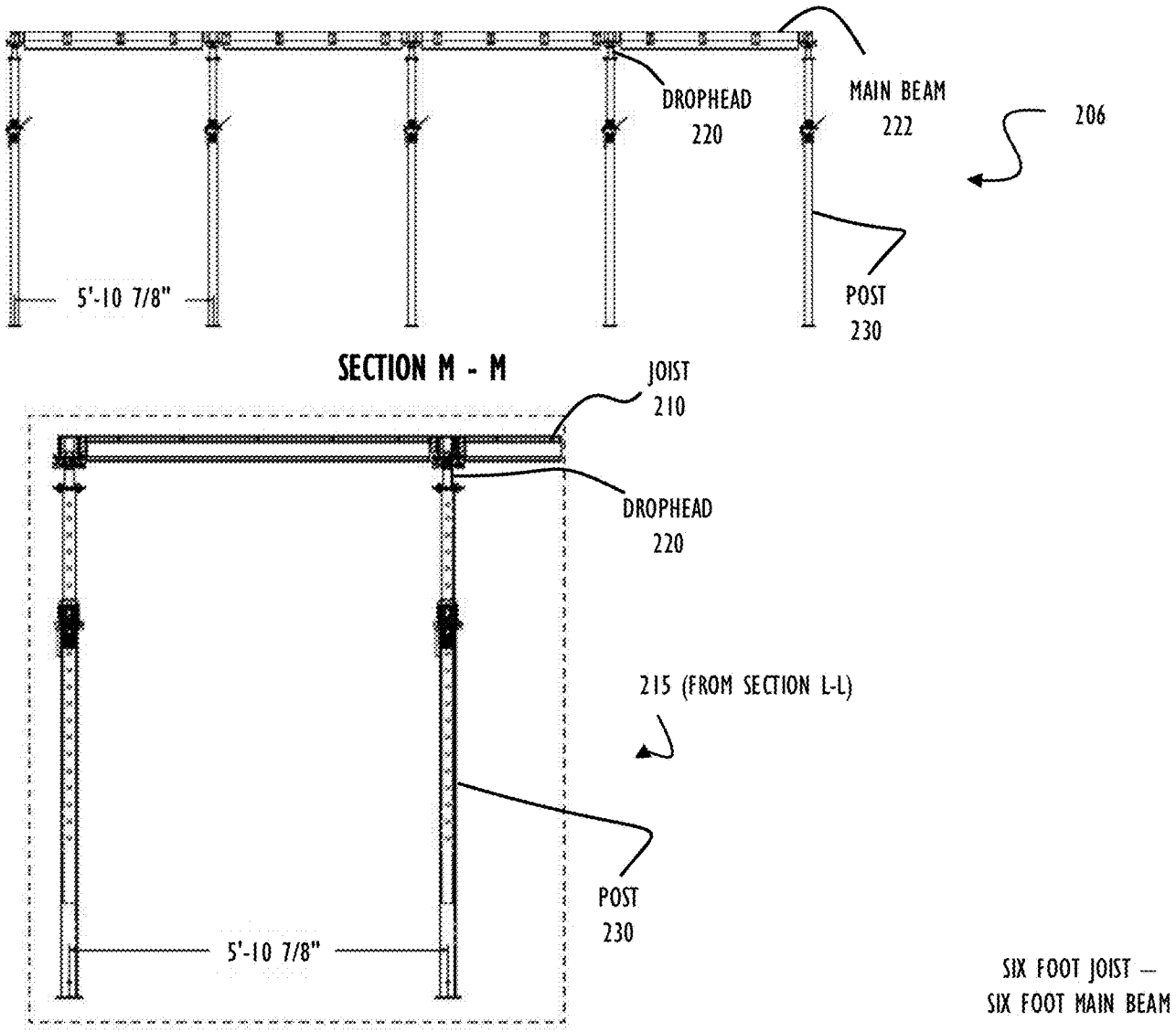
Figures 1, 2B:
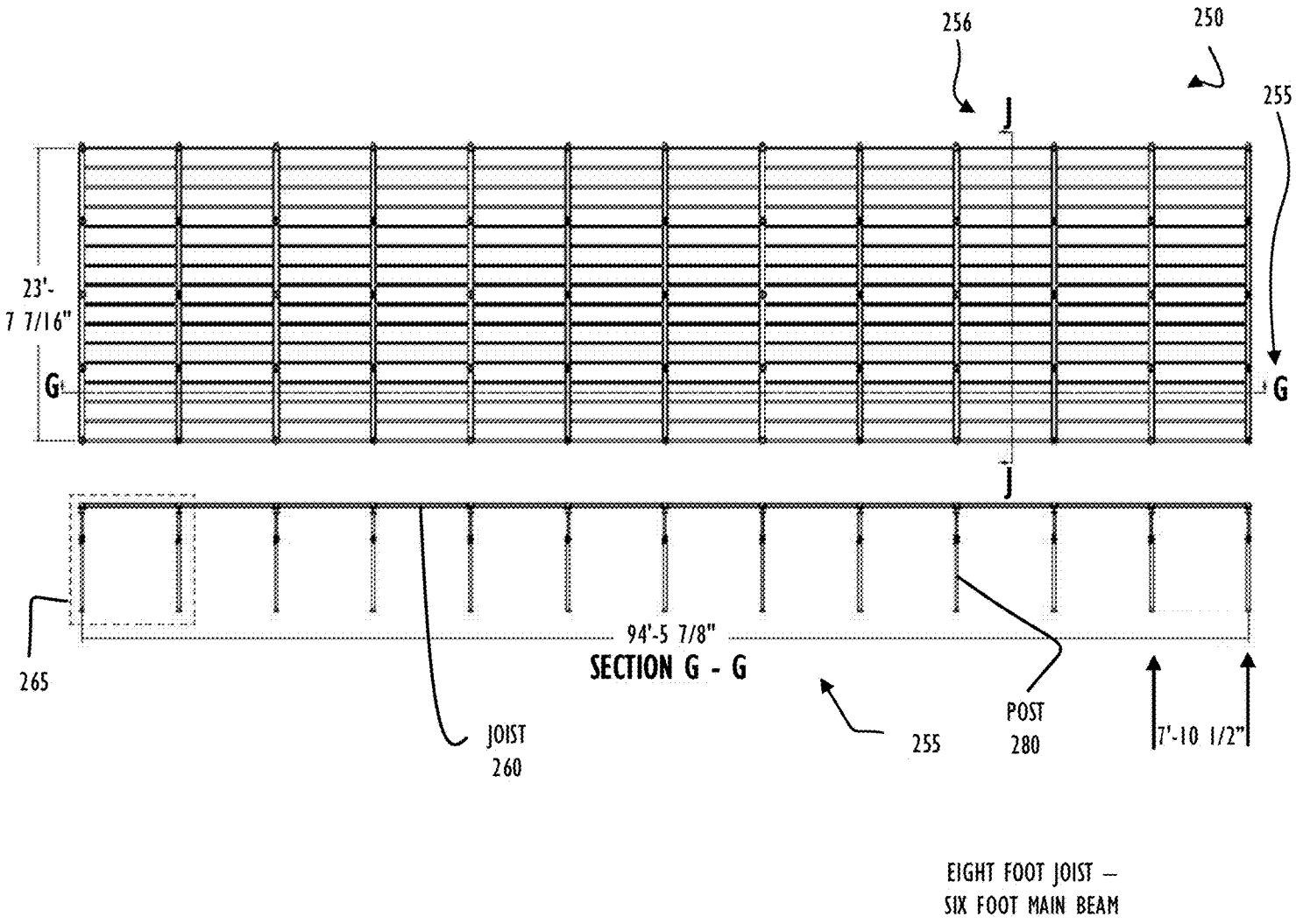
Figures 2, 2B:
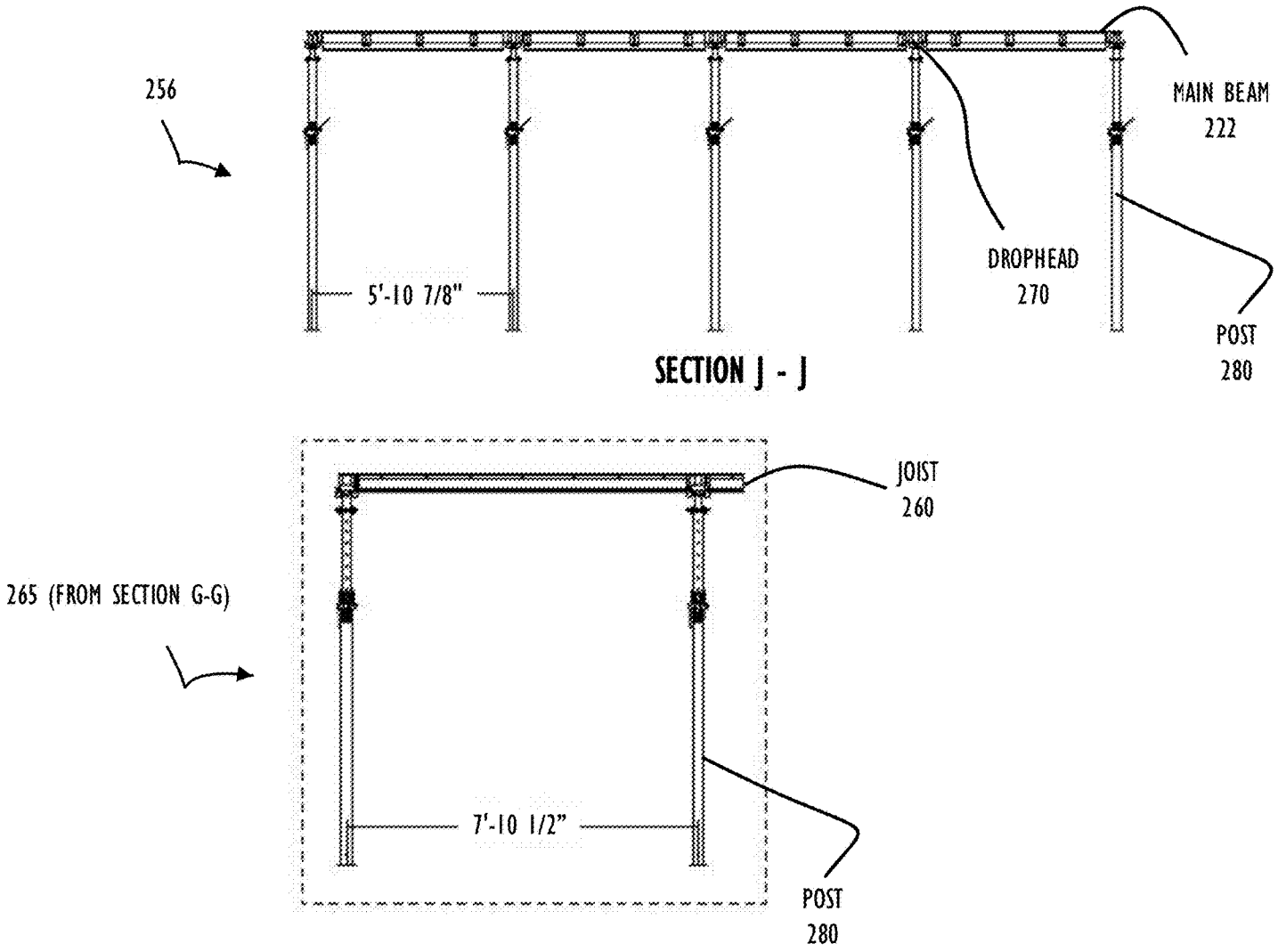
Figures 1, 2C:
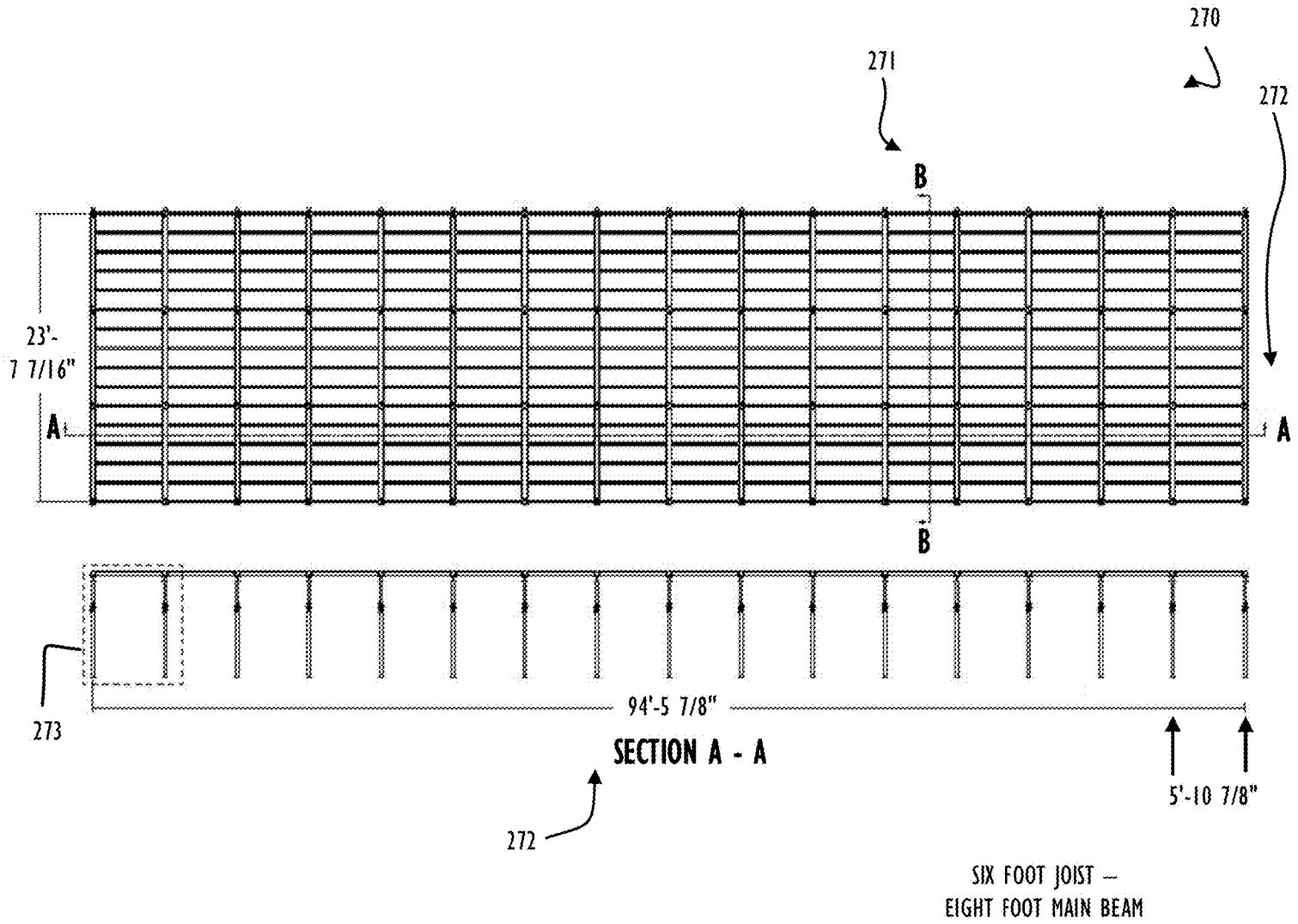
Figures 2, 2C:
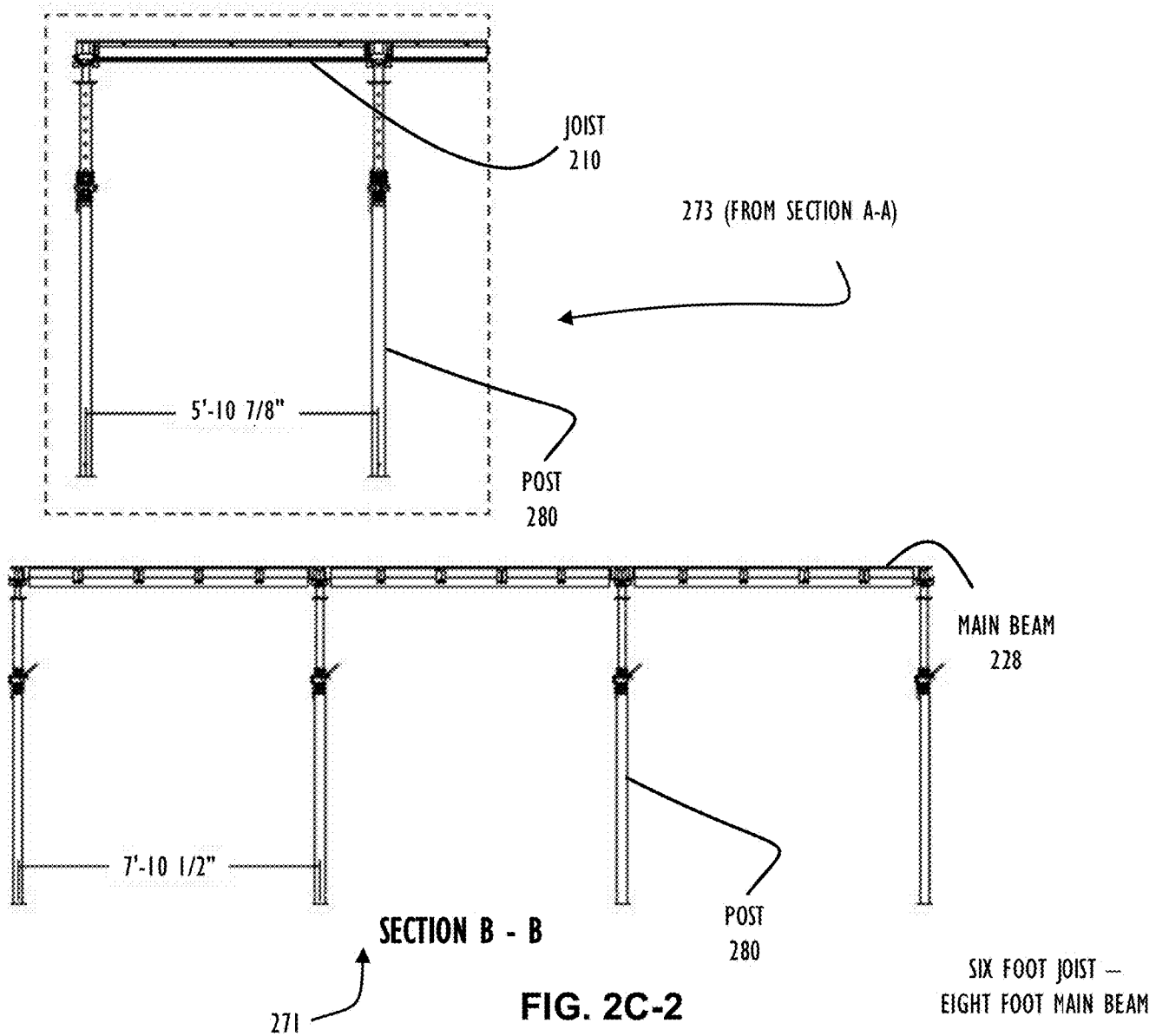
Figures 1, 2D:
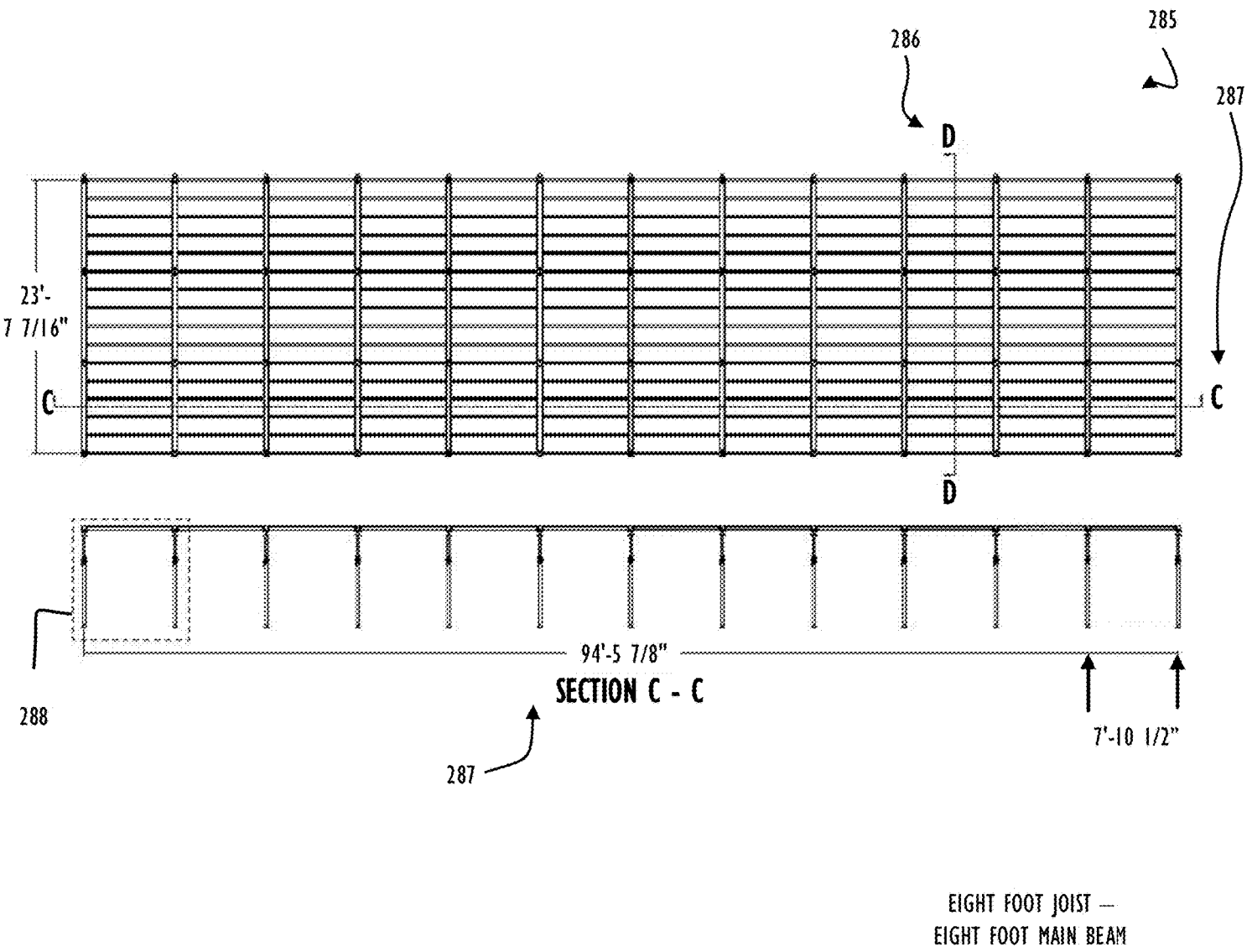
Figures 2, 2D:
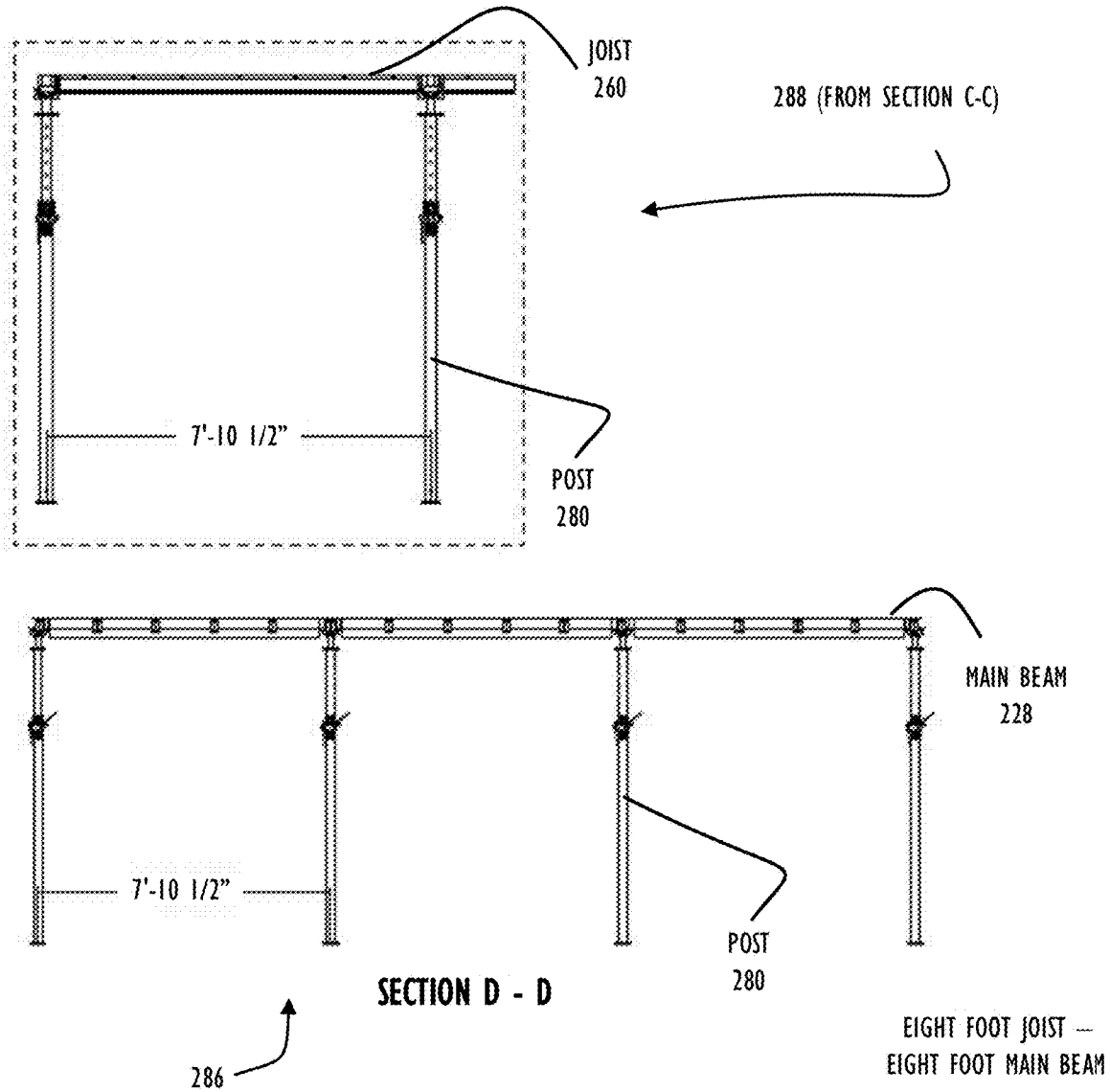

Referring now to FIGS. 2A-1, 2A-2, 2B-1, 2B-2, 2C-1, 2C-2, 2D-1, 2D-2 and 2E, four different examples of span for joists, main beams, and corresponding formwork components are illustrated. Specifically, FIGS. 2A-1 to 2A-2 illustrate a first six by six grid system for a defined area of 23'-7 7/16" by 94'-5 7/8" that is constructed of six foot main beams and six foot joists. To illustrate the reduction of components as discussed herein: FIGS. 2B-1 to 2B-2 illustrate a second grid system for the same defined area that is constructed of six foot main beams and eight foot joists; FIGS. 2C-1 to 2C-2 illustrate a third grid system for the same defined area that is constructed of eight foot main beams and six foot joists; and FIGS. 2D-1 to 2D-2 illustrate a fourth grid system for the same defined area that is constructed of eight foot main beams and eight foot joists.

Figure 2E:
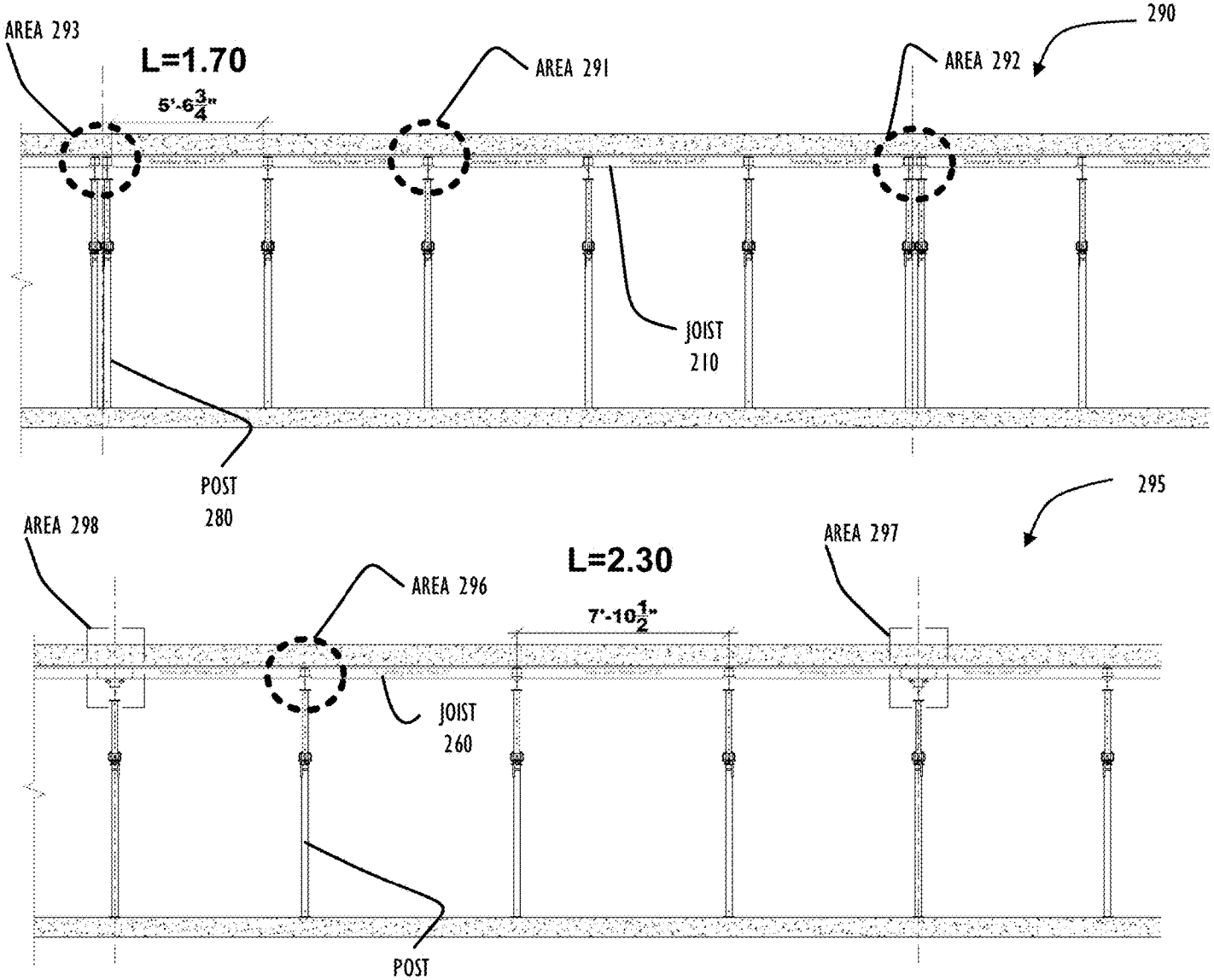
FIG. 2E illustrates two different techniques for assembling a joist run of the same length where efficiency of the eight foot joist and ears (e.g., top clipping tabs) on the main beam profile allow for an alternative assembly technique to reduce the number of formwork components required for the joist run, according to one or more disclosed implementations.

Each of the illustrations initially shows an overall grid system and identifies a vertical and horizontal cross section that is then enlarged to elaborate on the detail of each main beam run and joist run. Specifically, FIG. 2A-1 illustrates grid system 200 that includes cross sections M-M for main beams and L-L for joists. Section L-L identifies a section for joist run 205 is then shown enlarged at the bottom of FIG. 2A-1. FIG. 2A-2 continues the enlargement process by illustrating section M-M to identify main beam run 206 and portion 215 that is a further enlarge end portion of the joist run 205 shown for cross section L-L. Similar enlargements and cross sections are shown for each of the other three examples. FIG. 2E illustrates optional assembly techniques, possible based on the disclosed new profile designs, that may further reduce a number of components utilized.

In FIGS. 2A-1 and 2A-2, a grid system 200 is illustrated with several joist runs of just over 94 ft. each. In this example each joist 210 is just under six ft. in length. A single joist run 205 is illustrated as a cross-section L-L of grid system 200 and enlarged just below the grid system 200 to illustrate more detail for the single joist run 205. Running perpendicular to each joist run 205 in grid system 200 is a main beam run 206 that is illustrated as cross section M-M shown in enlarged detail on FIG. 2A-2. At the bottom of FIG. 2A-2, a portion of single joist run 205 is then further enlarged in portion 215. The portion 215 illustrates two posts 230, each with a drophead nut 220, and a single joist 210 spanning between them. This pattern is repeated to create the single joist run 205. In this example, a single joist run 205 includes 17 posts 230, 16 joists 210, and 17 drophead nuts 220 (main beams 222 are the same across each of these first two examples).

Turning to FIGS. 2B-1 and 2B-2, the simplified grid area example of FIGS. 2A-1 and 2A-2 is repeated with a substitution of eight ft. joists 260. Again, grid system 250 includes a plurality of joist runs and has a cross section G-G as a single joist run 255. Single joist run 255 is enlarged below grid system 250 and a portion 265 of that single joist run is further enlarged on FIG. 2B-2. FIG. 2B-2 also illustrates cross section J-J which is a single main beam run 256 from grid system 250. In this example, a single joist run 255 includes 13 posts 280 (savings of 4), 12 joists 260 (savings of 4), and 13 drophead nuts 220 (savings of 4). Thus, when this pattern is repeated to form complete grid system 250, there is a substantial reduction of number of formwork components that are utilized. As the comparison above explains, utilizing longer span joists may result in an overall reduction in formwork components for the same job site.

Turning to FIGS. 2C-1 and 2C-2, the simplified grid area example of FIGS. 2A-1 and 2A-2 is again repeated with a substitution of eight ft. main beams 228 and six ft. joists 210. Again, grid system 270 includes a plurality of joist and main beam runs and has a cross section A-A as a single joist run 272. Single joist run 272 is enlarged below grid system 270 and a portion 273 of that single joist run 272 is further enlarged on FIG. 2C-2. FIG. 2C-2 also illustrates cross section B-B which is a single main beam run 271 from grid system 270. In this example, a single joist run 272 includes 17 posts 280, 16 joists 210, and 17 drophead nuts 220 which is the same number of components as used in FIGS. 2A-1 and 2A-2. However, the single main beam run 271 utilizes only 4 instead of 5 main beams. Thus, when this main beam pattern is repeated to form complete grid system 250, there is a reduction of number of formwork components that are utilized. As the comparison above explains, utilizing longer span main beams may result in an overall reduction in formwork components for the same job site.

Turning to FIGS. 2D-1 and 2D-2, the simplified grid area example of FIGS. 2A-1 and 2A-2 is again repeated with a substitution of both eight ft. main beams 228 and eight ft. joists 260. This configuration produces an eight by eight grid and will recognize optimal savings across these four examples. Again, grid system 285 includes a plurality of joist and main beam runs and has a cross section C-C as a single joist run 287. Single joist run 287 is enlarged below grid system 285 and a portion 288 of that single joist run 287 is further enlarged on FIG. 2D-2. FIG. 2D-2 also illustrates cross section D-D which is a single main beam run 286 from grid system 285. In this example, a single joist run 287 includes 13 posts 280 (savings of 4), 12 joists 260 (savings of 4), and 13 drophead nuts 220 (savings of 4) relative to the number of components as used in FIGS. 2A-1 and 2A-2. Additionally, the single main beam run 286 utilizes only 4 instead of 5 main beams. Thus, when this main beam and joist beam pattern is repeated to form complete grid system 285, there is a substantial reduction of number of formwork components that are utilized.

As the comparison above explains, utilizing longer span main beams in conjunction with longer span joists may result in an overall reduction in formwork components for the same job site relative to the first three examples.

Turning to FIG. 2E, joist run 290 is illustrated utilizing six foot joists 210 and includes area 291, area 292, and area 293 which can be compared to similar areas in joist run 295 to illustrate different assembly techniques. Specifically, in area 293 and area 292, two posts 280 are required to support ends of adjacent joists 210. Area 291 of joist run 290 illustrates a "standard" use of a single drophead nut between two adjacent joists. Note, that because of the span of joist run 295 use of two posts 280 right next to each other is required. In contrast, joist run 295 illustrates area 298, area 296, and area 297 where an optional "overlay" technique may be used (i.e., allowed because of the longer joist 260 and an ability to clip the top joist to an ear of the main beam profile (See FIG. 8C)). Specifically, area 296 in joist run 295 illustrates the above referenced "standard" use of a single drophead nut. However, area 297 and 298 illustrate that the height of post 280 may be lowered and joist 260 may be overlaid on the drophead nut and butt against a next adjacent joist 260. Note the savings of joist run 295 versus joist run 290. There are nine posts utilized in joist run 290 and only six posts utilized in joist run 295.

As disclosed herein, improved main beam profiles (i.e., altering shape and amount of alloy material at angular and other portions of the profile) and use of enhanced materials (e.g., stronger aluminum alloy; stronger end-cap weld) in construction of main beams allows for an increased strength and span while maintaining interoperability with other existing formwork components. The overall width and height of a main beam may be maintained while increasing length. That is an "interoperable form factor" at points of connection between formwork components may be maintained while having increased performance of the intervening main beam portion (i.e., the span). There are no known prior art systems that increase a main beam length over six ft. and, if available, they likely alter their profile such that they do not have an "interoperable form factor" as disclosed herein and thus cannot function interchangeably with existing formwork components.

To increase strength and lengthen main beam span, profile changes have been determined that are discussed in more detail below. Further elements used to create each main beam may be enhanced. For example, an alloy with 37 min KSI yield may be used as opposed to 35 KSI yield as found in existing systems. KSI is a measure of strength (e.g., tensile strength or yield strength). Specifically, K reflects 1,000 pounds and SI refers to a square inch. Yield Strength (mathematically referenced as "F(y)") refers to the stress a material can withstand without permanent deformation or a point at which it will no longer return to its original dimensions (by 0.2% in length). Tensile Strength (mathematically referenced as "F(u)") refers to the maximum stress that a material can withstand while being stretched or pulled before failing or breaking.

Accordingly, an alloy with 37 min KSI yield strength and tensile strength reflects an alloy that could withstand 37,000 pounds per square inch without bending or breaking. When using these numbers to rate formwork components (and other items) an F(y) or F(u) is generally provided as a "minimum" amount. That is, the component is rated to withstand at least that much stress but may be able to withstand more than that amount. Thus, an engineer may use the minimum numbers to have confidence their design will remain stable to its expected stress conditions.

Figure 3:
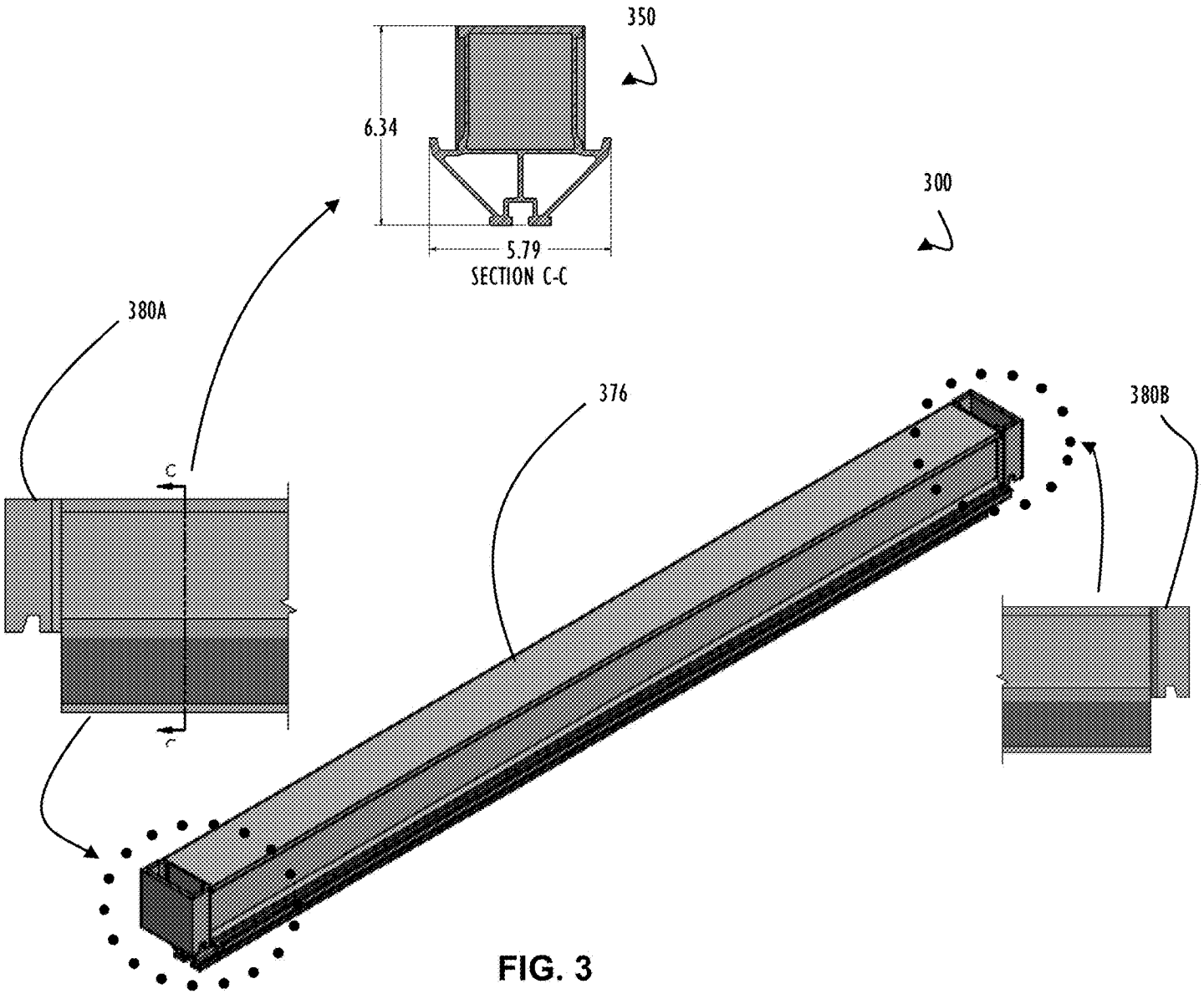
FIG. 3 illustrates a main beam with end-caps attached (e.g., welded onto each end), according to one or more disclosed implementations.

Referring now to FIG. 3, a main beam 300 is illustrated, according to one or more disclosed implementations. Main beam 300 is illustrated with attached end-caps 380A and 380B that are additionally shown as enlarged cutouts. Example main beam 300 includes end-caps 380A and 380B that are welded onto each end of middle main beam shaft 376. To allow each end-cap weld to take a larger load (e.g., not become a point of failure based on increased capacities of other components) a welding wire such as ER5356 may be used to form the end-cap weld. Changing the welding wire from ER4043 resulted in a breaking point improvement of almost 40%. Each of end-caps 380A and 380B may be used to connect a main beam to a drophead nut's mid-plate lip as discussed above in FIG. 1. Middle main beam shaft 376 provides strength for the above referenced span (i.e., length provided by a given main beam) and may have different main beam profiles (one example main beam profile 350 is illustrated) as discussed further below. Goals of main beam profiles include providing maximum supporting strength while minimizing weight of a main beam and providing durability to the main beam so that it is not easily damaged during use at a construction site (e.g., rugged environmental and use conditions). Disclosed main beam profiles further maintain an interoperable form factor (example exterior dimensions are shown in FIG. 3 for main beam profile 350) with prior art formwork components to allow interchangeable operation where appropriate.

Figure 4:
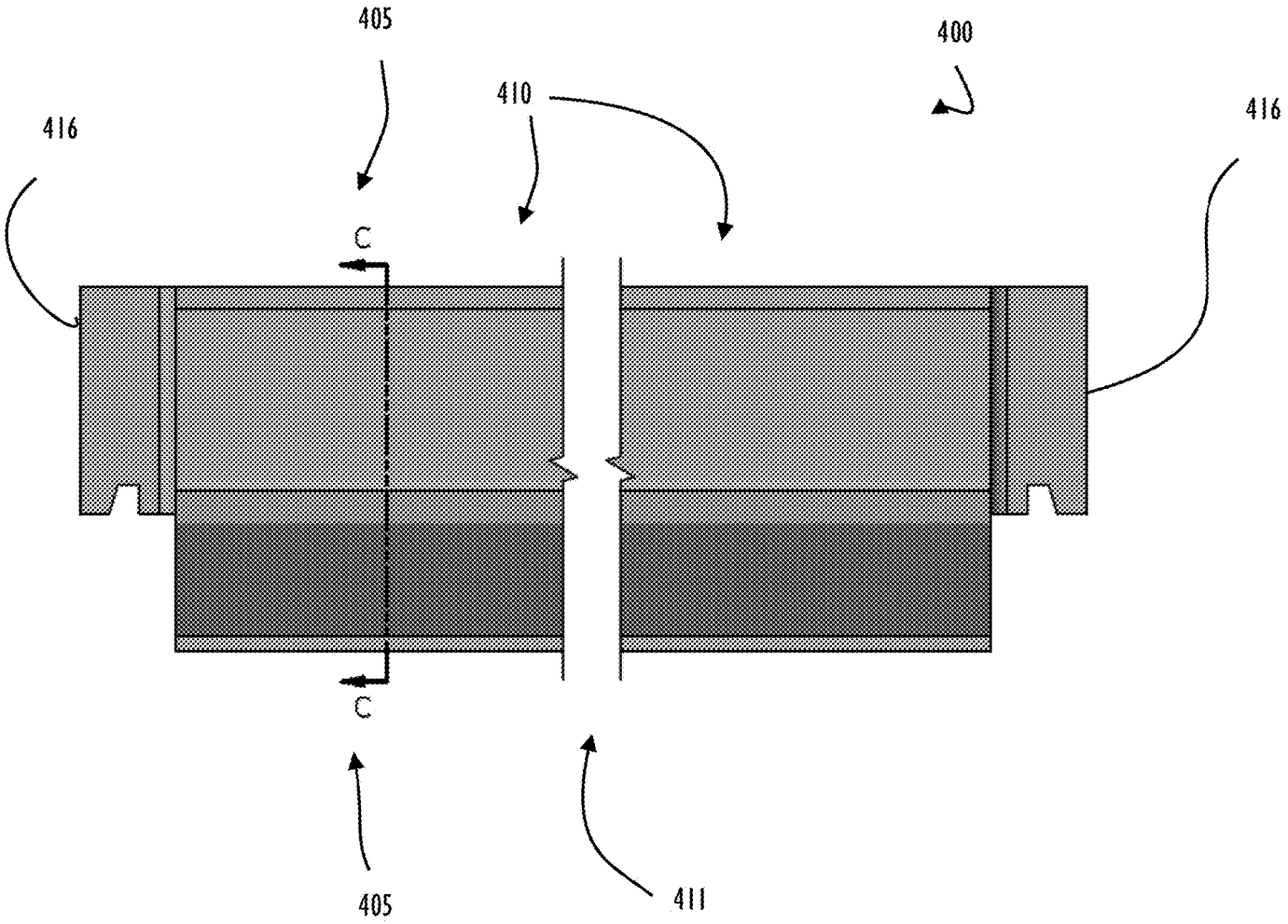
FIG. 4 illustrates a side view of a main beam with the mid-span cut-away and identifies an area that will be shown as a cross-section (different examples of the cross-section are illustrated in FIGS. 5A-7C), according to one or more disclosed implementations.

Referring now to FIG. 4, a side view of a main beam 400 is illustrated, according to one or more disclosed implementations. In the side view of FIG. 4, main beam 400 has the mid-span cut-away as indicated by gap 411. Main beam 400 also has a portion that identifies an area that will be shown and discussed below as a cross-section C-C indicated by arrows 405 at the top and bottom of main beam 400. Different examples of the cross-section C-C are illustrated in FIGS. 5A-7C to identify areas of alteration to allow for longer spans of a given main beam 400 (e.g., increasing from a 6 foot (1.7 meter) span to an 8 foot (2.4 meter) span or larger). Main beam 400 includes two side portions 410 on either side of gap 411. Each side portion 410 further include an end-cap 416 that may be welded onto a respective side portion 410. The end-caps 416 of FIG. 4 represent a different view of the end-caps 380A and 380B of FIG. 3.

Figure 5A:
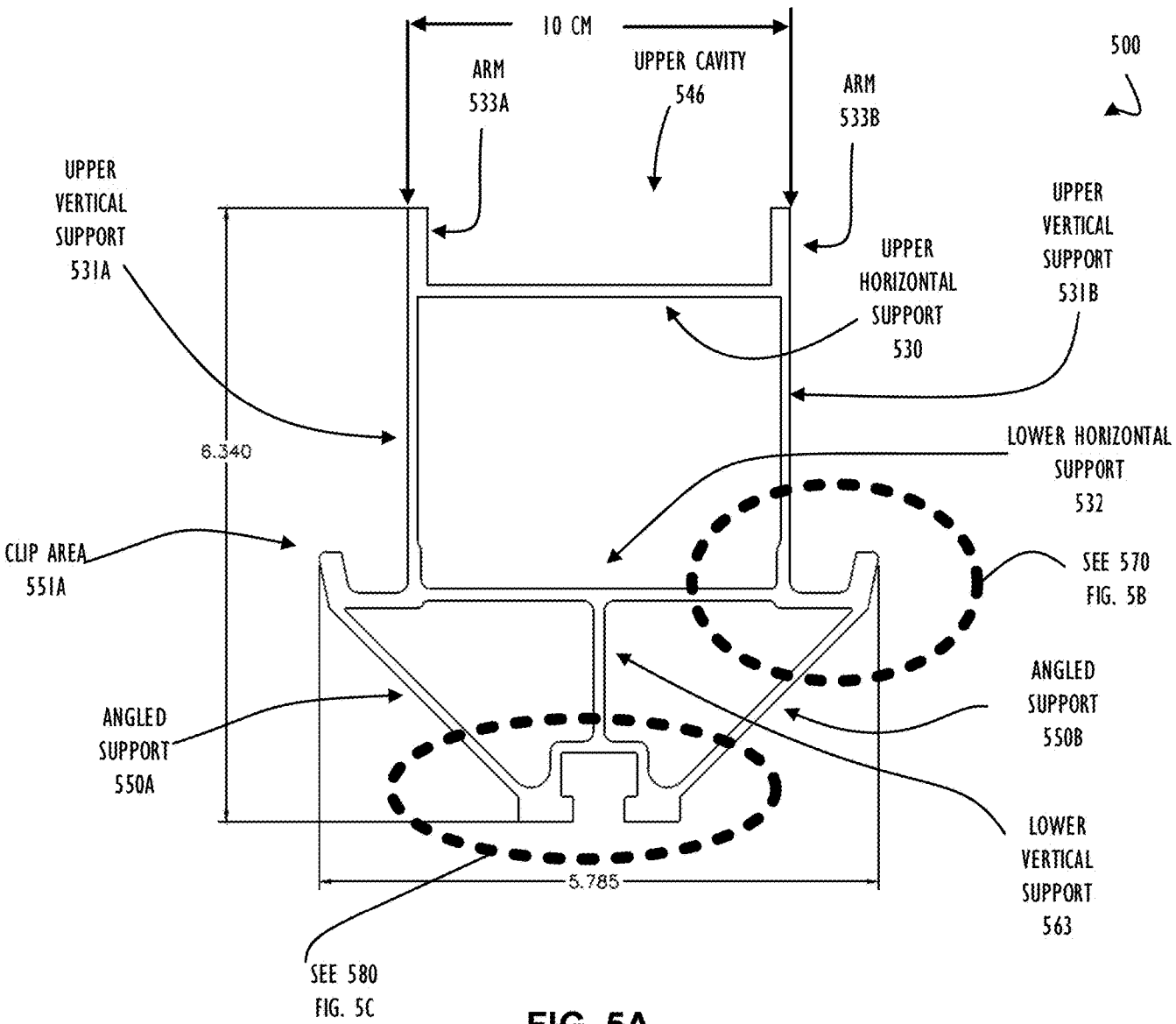
FIGS. 5A-C illustrate a first example cross-section (to illustrate a first "main beam profile") of a main beam, according to one or more disclosed implementations.

Referring now to FIGS. 5A through and 7C, several example cross-sections (to illustrate a different "main beam profiles") of a main beam are illustrated, according to one or more disclosed implementations. The first example main beam profile 500 is shown in FIG. 5A with enlarged view 570 provided in FIG. 5B and enlarged area 580 provided in FIG. 5C. Similar views are shown for each of FIGS. 6A-C and 7A-C for a second and third example main beam profile 600 and 700, respectively. All three example main beam profiles maintain an interoperable external form factor and can be used interchangeably (with respect to size but not weight capacities) with existing formwork components such as existing drophead nuts (e.g., drophead nut 150 of FIG. 1), existing main beam end-caps, and other formwork components.

In FIG. 5A, main beam profile 500 includes arm 533A and arm 533B on either side of upper horizontal support 530. Together these elements form upper cavity 546. Below arm 533B is upper vertical support 531B and below arm 533A is upper vertical support 531A. Lower horizontal support 532 spans between upper vertical support 531A and upper vertical support 531B. Clip area 551A is illustrated in FIG. 5A and a corresponding clip area 551B is illustrated in the enlarged view 570 of FIG. 5B. Angled support 550A is illustrated below clip area 551A and a respective adjacent angled support 550B is shown. Lower vertical support 563 provides additional vertical support and terminates in area 580 discussed below with reference to FIG. 5C.

Figure 5B:
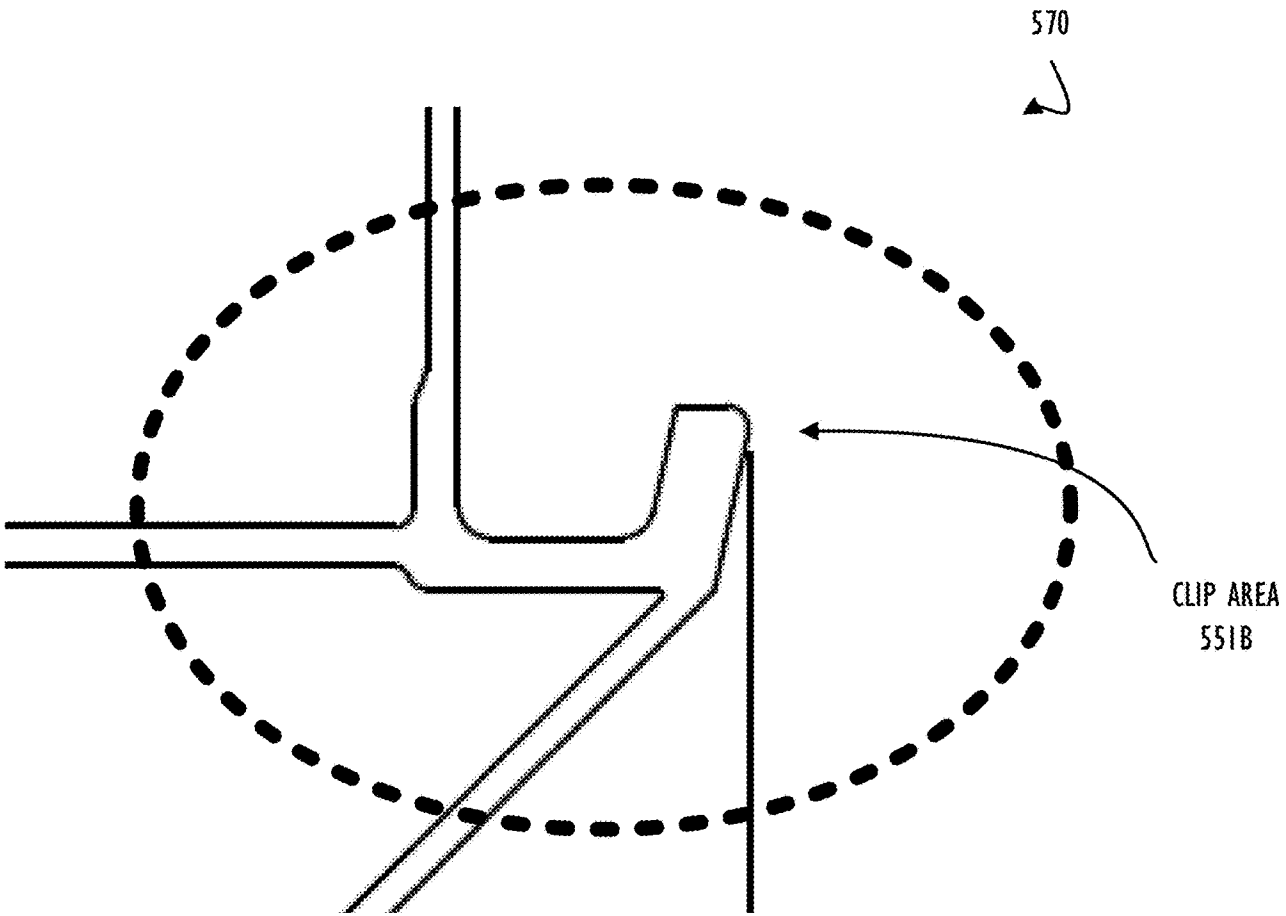
Figure 5C:
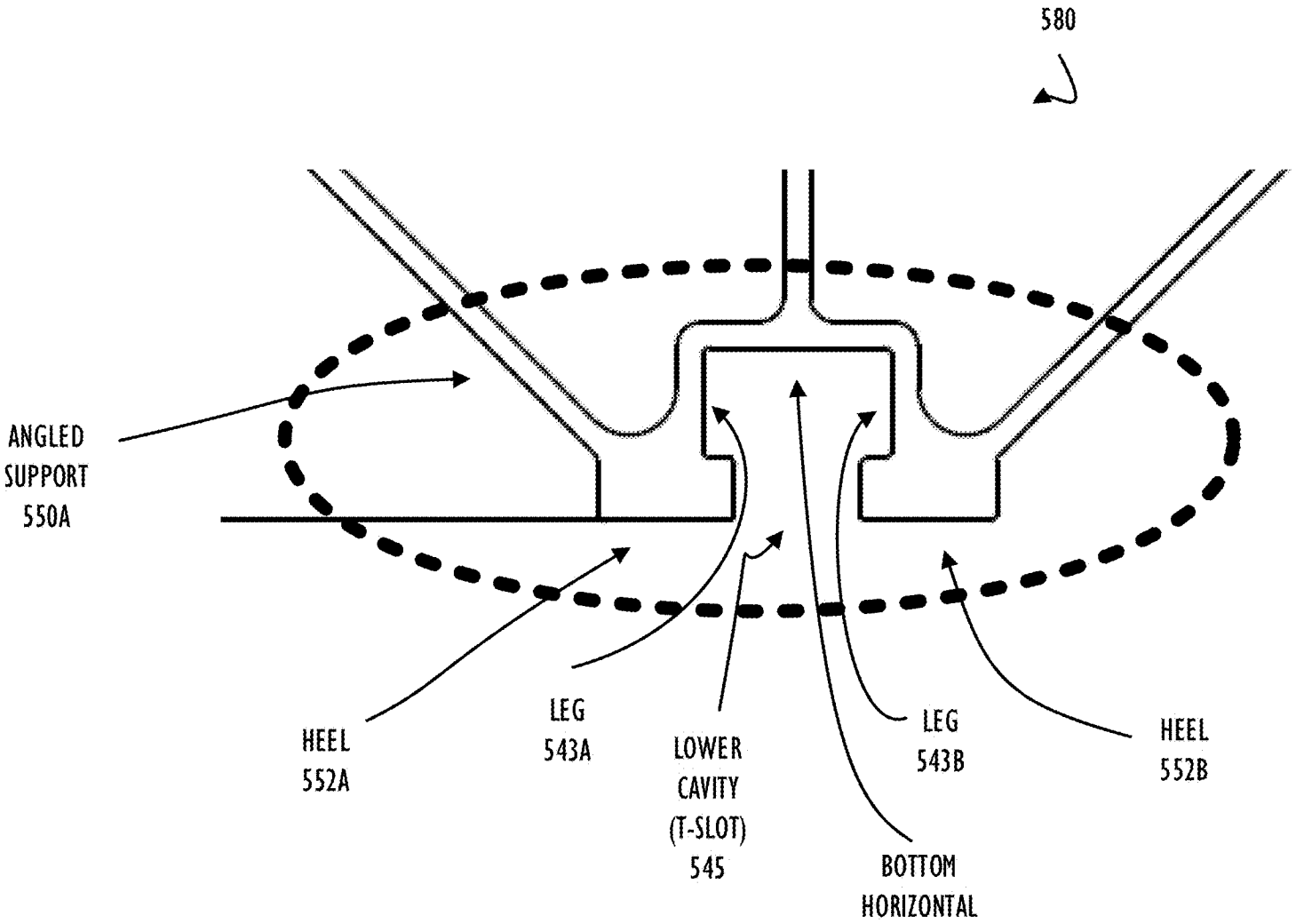

Turning to FIGS. 5B-C, enlarged view 570 of FIG. 5B illustrates clip area 551B and provides detail of the junction of different profile portions for the main beam profile 500. Enlarged view of area 580 of FIG. 5C illustrates that main beam profile 500 includes heel 552A at the base of angled support 550A and attached to the bottom of leg 543A. A corresponding heel 552B on the other side of main beam profile 500 is attached to the bottom of leg 543B. Between leg 543A and leg 543B (also above heel 552A and heel 552B), lower cavity (T-slot) 545 is illustrated and is beneath bottom horizontal support 544.

Figure 6A:
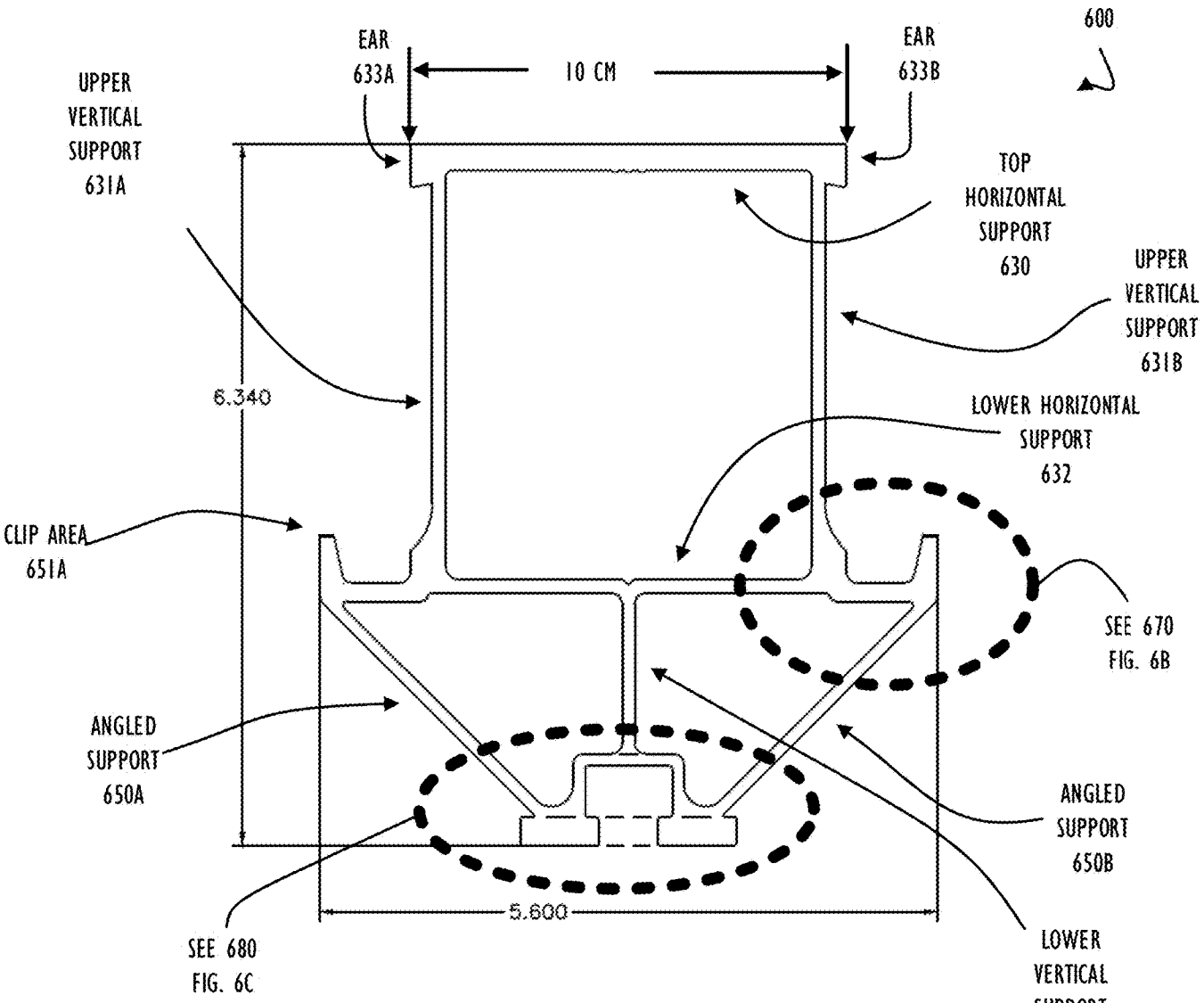
FIGS. 6A-C illustrate a second example cross-section (to illustrate a second "main beam profile") of a main beam that may support a longer span than the first main beam profile, according to one or more disclosed implementations.

In FIG. 6A, main beam profile 600 includes ear 633A and ear 633B on either side of top horizontal support 630 which, in this example, has a span of 10 cm. that is consistent with the outer dimensions of arm 533A and 533B as indicated in main beam profile 500. In main beam profile 600 the upper cavity 546 from main beam profile 500 is eliminated. Below ear 633B is upper vertical support 631B and below ear 633A is upper vertical support 631A. Note that ear 633A and ear 633B do not extend the external distance beyond the indicated 10 cm. distance and instead are formed by inward repositioning of portions of upper vertical support 631A and upper vertical support 631B. Lower horizontal support 632 spans between the base of upper vertical support 631A and the base of upper vertical support 631B. Clip area 651A is illustrated in FIG. 6A and a corresponding clip area 651B is illustrated in the enlarged view 670 of FIG. 6B. Angled support 650A is illustrated below clip area 651A and a respective adjacent angled support 650B is shown on the opposite side of main beam profile 600. Lower vertical support 663 provides additional vertical support and terminates in area 680 discussed below with reference to FIG. 6C.

Figure 6B:
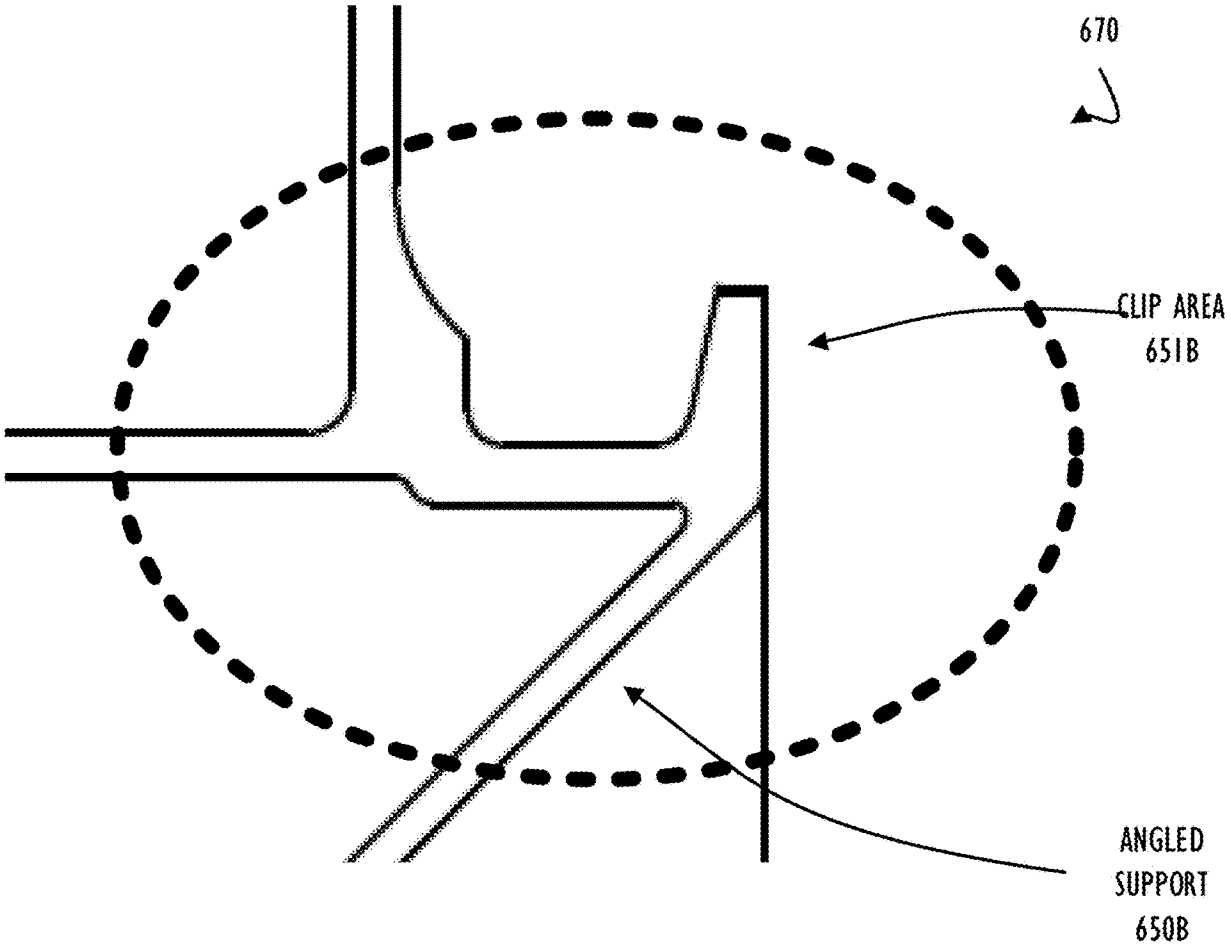
Figure 6C:
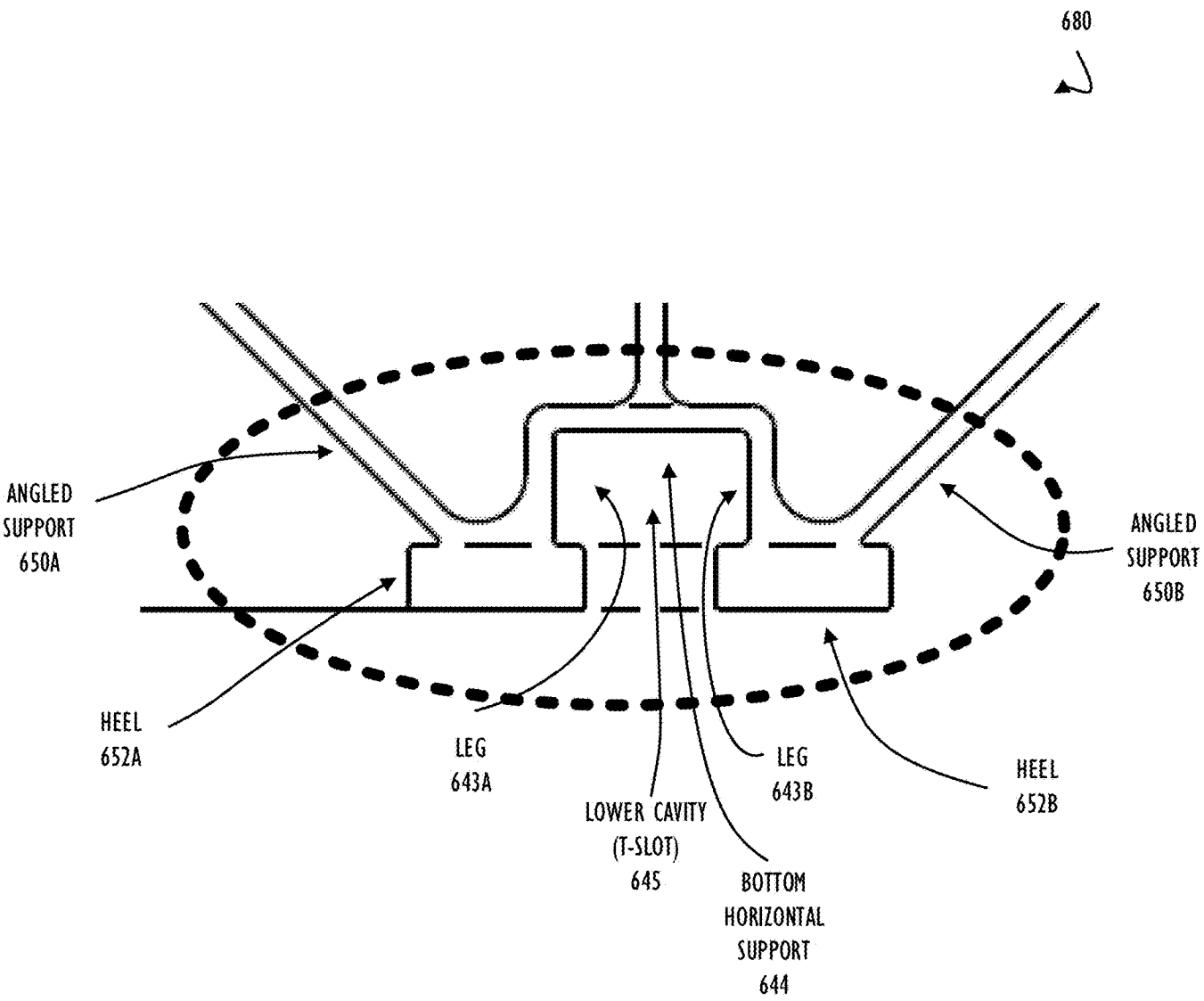

Turning to FIGS. 6B-C, enlarged view 670 of FIG. 6B illustrates clip area 651B and provides detail of the junction of different profile portions for the main beam profile 600. Note the shape difference illustrated in view 670 relative to view 570 for the junction of upper vertical support 631B and lower horizontal support 632. Specifically, additional material (i.e., aluminum alloy) has been added to the external side of upper vertical support 631B (and removed from the internal side). Enlarged area 680 of FIG. 5C illustrates that main beam profile 600 includes heel 652A at the base of angled support 650A and attached to the bottom of leg 643A. A corresponding heel 652B on the other side of main beam profile 600 is attached to the bottom of leg 643B. Between leg 643A and leg 643B (also above heel 652A and heel 652B), lower cavity (T-slot) 645 is illustrated and is beneath bottom horizontal support 644. Note that each of heel 652A and heel 652B extend beyond the junction of their corresponding angled support and provide a lip area that is not present in main beam profile 500.

Figure 7A:
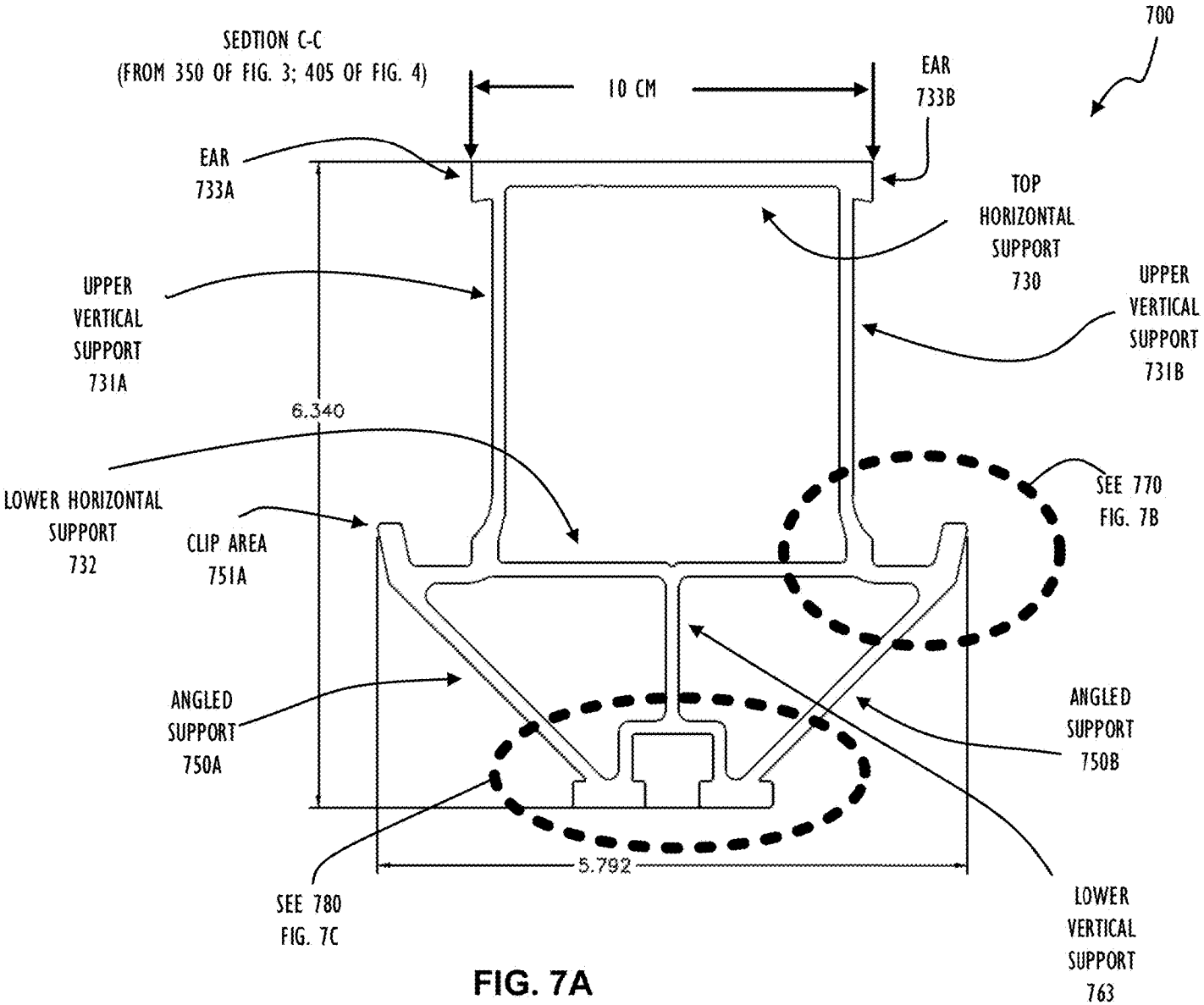
FIGS. 7A-C illustrate a third example cross-section (to illustrate a third "main beam profile") of a main beam that may support a longer span than either the first or second main beam profile, according to one or more disclosed implementations.

In FIG. 7A, main beam profile 700 includes ear 733A and ear 733B on either side of top horizontal support 730 which maintains the external dimension of 10 cm. as discussed above. In main beam profile 700 the upper cavity 546 from main beam profile 500 is eliminated. Below ear 733B is upper vertical support 731B and below ear 733A is upper vertical support 731A. Lower horizontal support 732 spans between the base of upper vertical support 731A and the base of upper vertical support 731B. Clip area 751A is illustrated in FIG. 7A and a corresponding clip area 751B is illustrated in the enlarged view 770 of FIG. 7B. Angled support 750A is illustrated below clip area 751A and a respective adjacent angled support 750B is shown on the opposite side of main beam profile 700. Lower vertical support 763 provides additional vertical support and terminates in area 780 discussed below with reference to FIG. 7C.

Figure 7B:
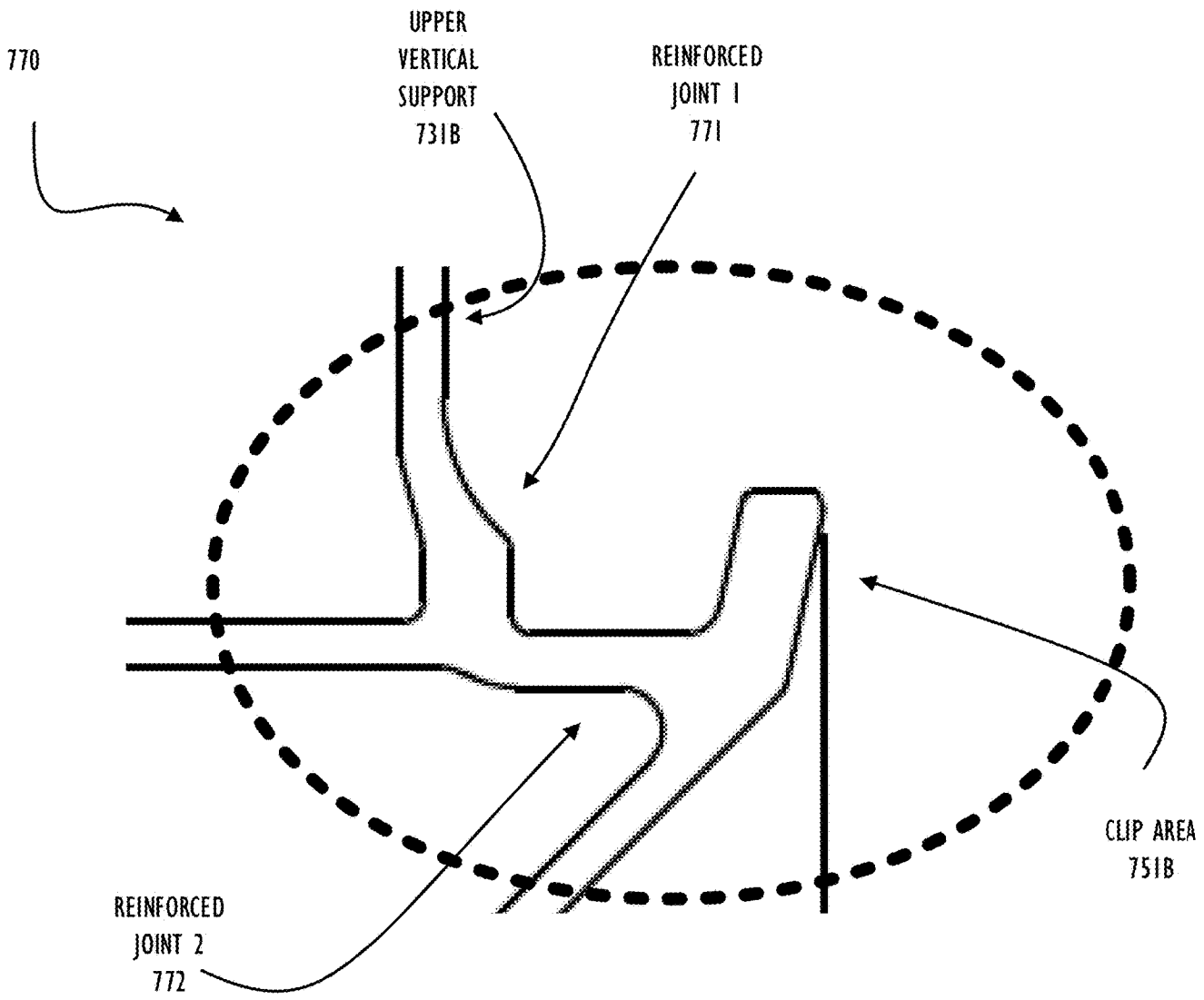
Figure 7C:
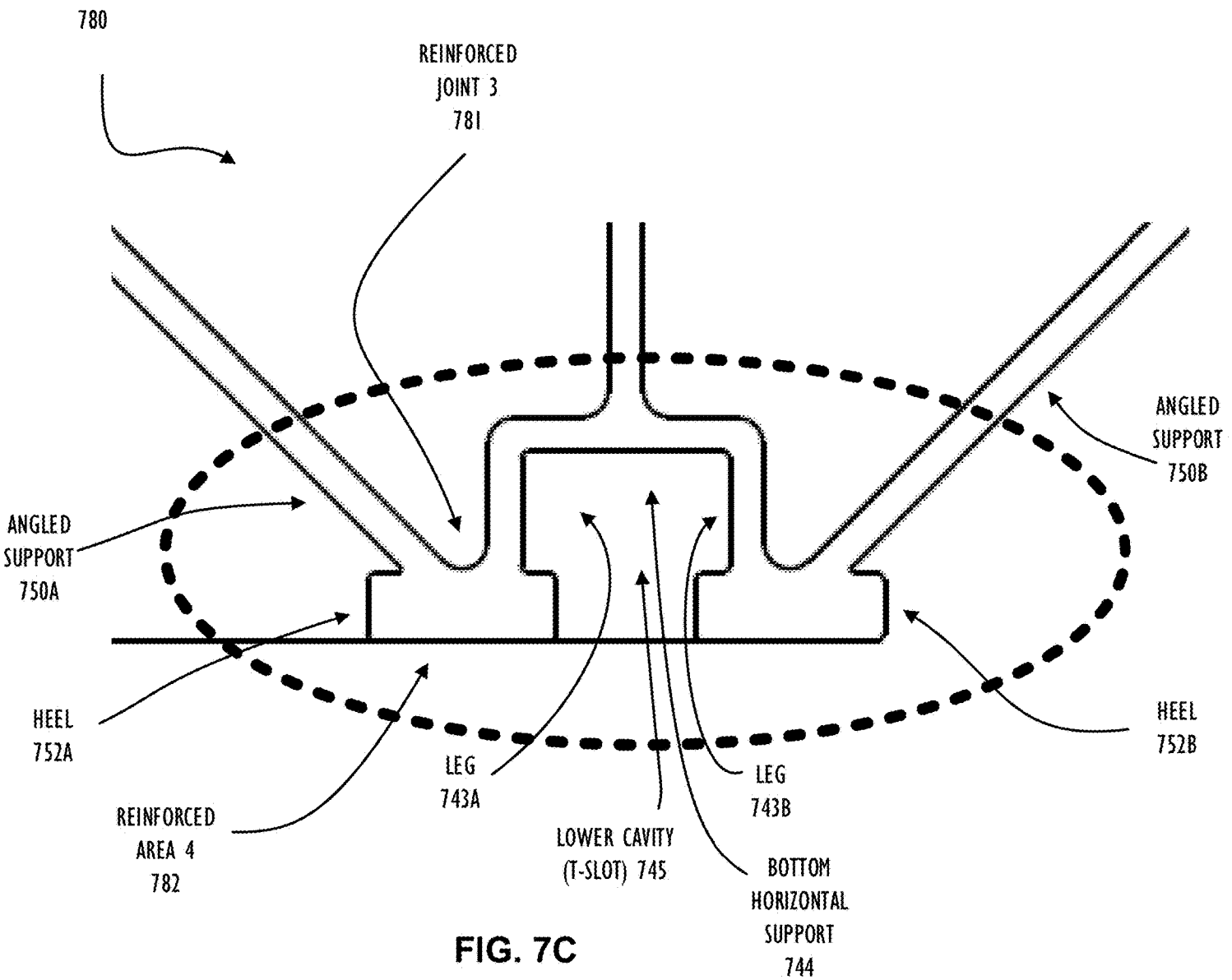

Turning to FIGS. 7B-C, enlarged view 770 of FIG. 7B illustrates clip area 751B and provides detail of the junction of different profile portions for the main beam profile 700.

Note the shape difference illustrated in view 770 relative to view 570 and view 670 for the junction of upper vertical support 731B and lower horizontal support 732. Specifically, additional material (i.e., aluminum alloy) has been added to the external side of upper vertical support 631B (and removed from the internal side) to produce reinforced joint 1 (771). Additional material has also been added to the lower portion of lower horizontal support 732 to produce reinforced joint 2 (772) including additional material at the base of clip area 751B relative to the same point on main beam profile 600 and main beam profile 500. Specifically, reinforced joint 2 (772) provides additional strength to allow for added loads of longer joists. Enlarged area 780 of FIG. 7C illustrates that main beam profile 700 includes heel 752A at the base of angled support 750A and a corresponding heel 752B on the other side of main beam profile 700 is attached to the bottom of leg 743B.

Between leg 743A and leg 743B (also above heel 752A and heel 752B), lower cavity (T-slot) 745 is illustrated and is beneath bottom horizontal support 744. Note that each of heel 752A and heel 752B again extend beyond the junction of their corresponding angled support and provide a lip area that is not present in main beam profile 500 but was present in main beam profile 600. Also, each heel of main beam profile 700 has been enlarged to produce reinforced joint 3 (781) and reinforced area 4 (782). The areas of reinforcement may be observed by comparing against corresponding areas of main beam profile 600 (or main beam profile 500).

As briefly mentioned above with respect to reinforcement areas, to increase strength of joist profile 600 over joist profile 500 and to increase strength of joist profile 700 over joist profile 600 some adjustments in manufacturing have been provided and are now outlined. Other embodiments may have still further adjustments than those specifically listed here. Additional material (e.g., 37 KSI yield aluminum alloy) has been added to each reinforcement area to make them thicker and provide additional strength. To be clear, in some implementations, the entire profile is constructed of additional amounts of improved alloy (e.g., 37 KSI yield rather than 35 KSI yield). The combination of the stronger material and/or more of the alloy material (i.e., to make specific portions of the joist profile thicker) results in an entire profile that may be used to create main beams that are substantially stronger (and thus support longer spans) than prior art profiles were capable of providing. Additional material (e.g., 37 KSI yield aluminum alloy) may also be added to each top horizontal support 630 or 730 and to vertical supports (e.g., upper vertical support 731B, lower vertical support 763, and/or angled support 750B) such that they are thicker than the corresponding aspects of main beam profiles 500 or 600. In one example, the thickness of upper vertical support 531A, upper horizontal support 530, upper vertical support 531B, lower horizontal support 532, lower vertical support 563, and both of angled support 550A and angled support 550B are 0.10 cm. In contrast, implementations of main beam profile 700 may utilize a thickness of 0.13 cm for the corresponding elements and include an increased thickness for top horizontal support 730.

Referring now to FIGS. 8A-E that illustrate possible assembly techniques utilizing a "clipping" technique that is possible for each of the main beam profiles 600, and 700 described above, according to one or more disclosed implementations. These clipping techniques provide alternative assembly techniques when constructing a formwork grid system such as those illustrated in FIGS. 2A-E. In particular they allow for a cantilever of a joist 260 over a main beam without having the joist flip when weight is provided beyond a pivot point of an intermediate main beam.

Figure 8A:
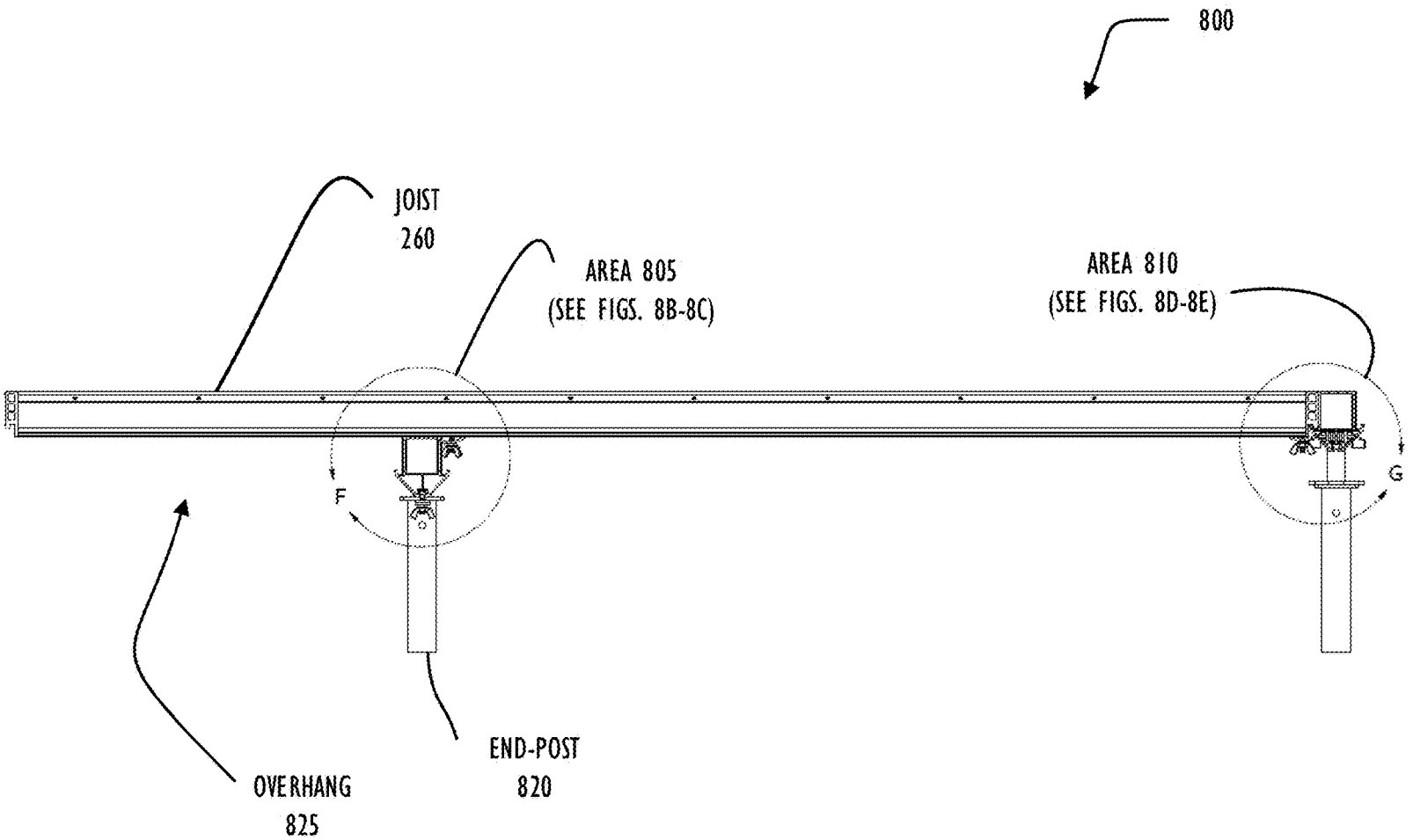
FIGS. 8A-E illustrate assembly techniques utilizing "clipping" that are possible for at least the third main beam profile of FIGS. 7A-C, according to one or more disclosed implementations.

FIG. 8A illustrates an example formwork section 800 that includes a joist overhang 825 for joist 260 that may be present at an edge of a building platform. That is, the overhang 825 extends beyond end-post 820 in this example. To extend beyond end-post 820, joist 260 overlays main beam 228 in area 805 (illustrated using enlarged view 830 and enlarged view 840 in FIGS. 8B-C) and is clipped at the point of overlay (area 805) (e.g., to prevent lateral movement or other movement during assembly). Joist 260 is further clipped to main beam 228 in area 810 (illustrated using enlarged view 850 and enlarged view 860 in FIGS. 8D-E). A T-slot at the bottom of each joist 260 allows fastening of top joists to a main beam ear (e.g., ears 633A-B, and 733A-B) illustrated in each of main beam profiles 600 and 700. Some main beam profiles, like main beam profile 500, lack an ear portion and therefore cannot be clipped in the manner illustrated in FIG. 8A. Also, the lower cavity (T-Slot) 545, 645, and 745 of each of main beam profiles 500, 600, and 700, respectively may be used to perform clipping as illustrated in area 805 of FIGS. 8A-C. Area 810 illustrates how clipping a joist 260 at one end to a main beam clip area (e.g., clip area 551A-B, clip area 651A-B, or clip area 751A-B) may allow the other end to provide overhang 825 (e.g., joist 260 won't pivot at overlay when weight is present on top of overhang 825).

Figure 8B:
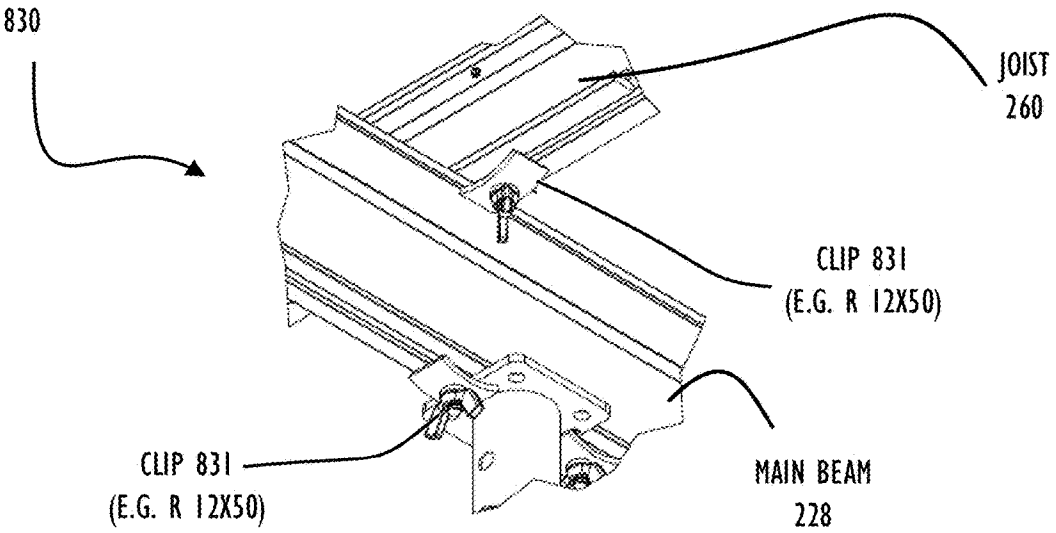
Figure 8C:
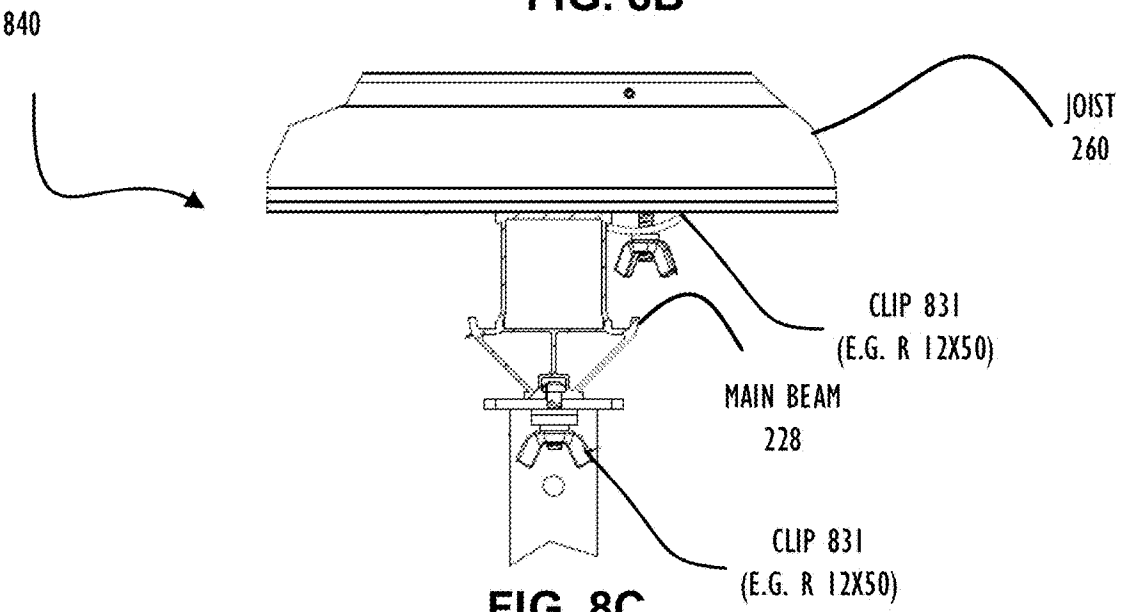

Referring now to FIGS. 8B-C, enlarged view 830 is provided in FIG. 8B and enlarged view 840 is provided in FIG. 8C. Each of these views illustrate an interaction between instances of clip 831 (e.g., a R 12×50 clip) and other formwork components as described above. In particular, a T-slot at the base of main beam 228 may be used to secure the base of main beam 228 to a drophead nut (uppermost portion of a support post vertical support) and the T-slot at the base of the joist profile of joist 260 may be used to secure the bottom of joist 260 to a formwork component that it lays upon (assuming that formwork component has a proper clipping location such as ears 633A-B or 733A-B).

Figure 8D:
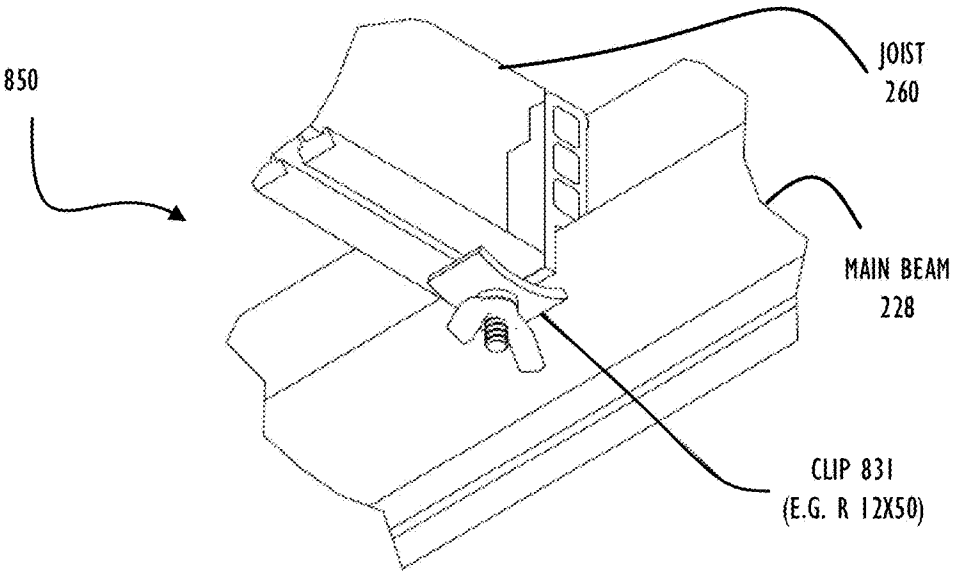
Figure 8E:
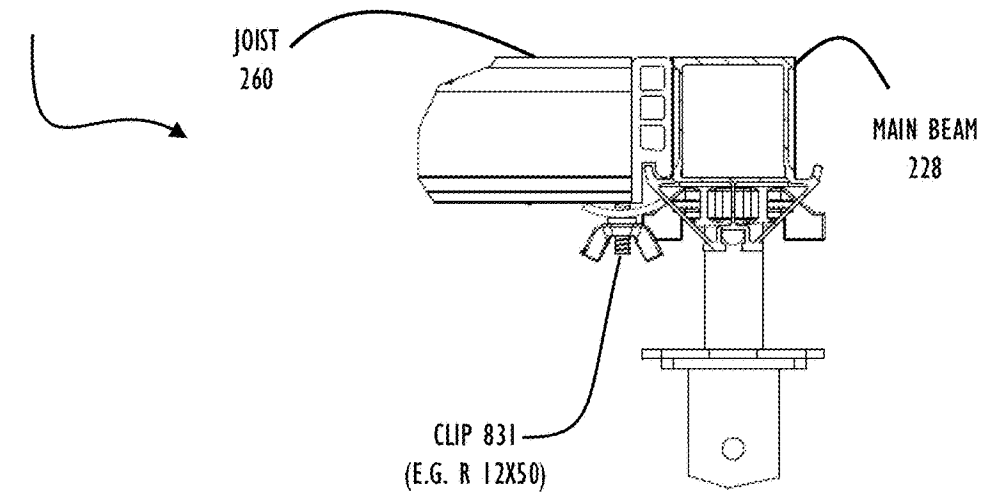

Referring now to FIGS. 8D-E, enlarged view 850 is provided in FIG. 8D and enlarged view 860 is provided in FIG. 8E. Each of these views illustrate an interaction between instances of clip 831 and other formwork components as described above. In particular, enlarged view 850 illustrates joist 260 clipping (via its T-slot) to main beam 228 at its clip area. Enlarged view 860 illustrates the same connection technique from a different perspective view.

While the embodiments are described with reference to various implementations and exploitations, it will be understood that these embodiments are illustrative and that the scope of the inventive subject matter is not limited to specifically disclosed implementations. Many variations, modifications, additions, and improvements are possible.

Plural instances may be provided for components, operations, or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . " Also, the term "couple" or "couples" is intended to mean either an indirect or direct connection. Thus, if a first component couples to a second component, that coupling may be through a direct connection or through an indirect connection via other components and connections. In this disclosure a direct connection will be referenced as a "connection" rather than a coupling. The recitation "based on" is intended to mean "based at least in part on." Therefore, if X is based on Y, X may be a function of Y and any number of other factors.

The above discussion is meant to be illustrative of the principles and various implementations of the present disclosure. Numerous variations and modifications will become apparent to those skilled in the art once the above disclosure is fully appreciated. It is intended that the following claims be interpreted to embrace all such variations and modifications.

What is claimed is:

1. A main beam formwork construction component having a main beam profile, the main beam profile comprising:

a top horizontal support of 10 centimeters or less in width, the top horizontal support including a first ear integral with a first end of the top horizontal support and a second ear integral with a second end of the top horizontal support;

a lower horizontal support having a first end extending into a first clip area and a second end extending into a second clip area, wherein a cumulative width of the first clip area, the second clip area, and the lower horizontal support is greater than 10 centimeters;

a first upper vertical support attached at an inner side of the first ear at the first end of the top horizontal support and spanning between the top horizontal support and the lower horizontal support; and a second upper vertical support attached at an inner side of the second ear at the second end of the top horizontal support and spanning between the top horizontal support and the lower horizontal support.

2. The main beam formwork construction component of claim 1, the main beam profile further comprising:

a lower vertical support attached to the lower horizontal support;

a bottom horizontal support at a base of the lower vertical support;

a first leg and a second leg attached to respective sides of the bottom horizontal support;

a first heel at a respective base of the first leg and a first angled support; and a second heel at a respective base of the second leg and a second angled support, wherein an inner perimeter defined by the first heel, second heel, first leg, second leg, and bottom horizontal support forms a lower cavity T-slot for the main beam profile, and wherein the first angled support and the second angled support extend linearly without bend from respective bases of respective legs.

3. The main beam formwork construction component of claim 1, wherein the main beam profile maintains interoperable external dimensions.

4. The main beam formwork construction component of claim 1, wherein the main beam profile is utilized for a shaft portion of a main beam and wherein the main beam includes a pair of end-caps welded onto respective ends of the main beam using ER5356 welding wire to form the main beam having at least 1.70 m in length.

5. The main beam formwork construction component of claim 1, wherein the main beam profile further comprises:

a first angled support connected to the first clip area;

a second angled support connected to the second clip area, the first and second angled supports extending linearly without bend and angling inward toward a center of the main beam profile; and a first pair of reinforced joints, each of the first pair of reinforced joints at a respective connection between the lower horizontal support and respective ones of the first angled support and the second angled support.

6. The main beam formwork construction component of claim 1, wherein the main beam profile further comprises:

a lower vertical support attached to the lower horizontal support;

a bottom horizontal support at a base of the lower vertical support;

a first leg and a second leg attached to respective sides of the bottom horizontal support;

a first angled support connected to the first clip area;

a second angled support connected to the second clip area, the first and second angled support extending linearly without bend and angling inward toward a center of the main beam profile;

a first heel at a respective base of the first leg and the first angled support; and a second heel at a respective base of the second leg and the second angled support, wherein each of the first heel and second heel extend beyond a junction of a corresponding angled support to provide a lip area.

7. The main beam formwork construction component of claim 6, wherein the main beam profile further comprises a first reinforced area for each of the first heel and the second heel.

8. The main beam formwork construction component of claim 6, wherein the main beam profile further comprises:

a first pair of reinforced joints, each of the first pair of reinforced joints at a respective base of each of the first upper vertical support and the second upper vertical support;

a second pair of reinforced joints, each of the second pair of reinforced joints at a respective connection between the lower horizontal support and respective ones of the first angled support and the second angled support; and a third pair of reinforced joints, each of the third pair of reinforced joints at a respective connection between respective ones of the first angled support, the second angled support, the first heel, and the second heel.

9. The main beam formwork construction component of claim 8, wherein the main beam profile further comprises a first reinforced area for each of the first heel and the second heel.

10. The main beam formwork construction component of claim 1, wherein the main beam profile has an external dimension of less than 6.4 inches in height and 5.8 inches in width.

11. A formwork grid system constructed from a plurality of formwork components, the formwork grid system comprising:

a main beam run of at least 23 feet, the main beam run including a maximum of four (4) props and three (3) main beams, wherein at least one of the main beams is made of an aluminum alloy and utilizes a main beam profile that includes:

a top horizontal support of 10 centimeters or less in width;

a lower horizontal support having a first end extending into a first clip area and a second end extending into a second clip area, wherein a cumulative width of the first clip area, the second clip area, and the lower horizontal support is greater than 10 centimeters;

a first upper vertical support extending from the top horizontal support and spanning between the top horizontal support and the lower horizontal support;

a second upper vertical support extending from the top horizontal support and spanning between the top horizontal support and the lower horizontal support;

a first angled support connected to the first clip area; and a second angled support connected to the second clip area, the first and second angled supports extending linearly without bend and angling inward toward a center of the main beam profile.

12. The formwork grid system of claim 11, further comprising:

a joist run of at least 94 feet, the joist run including a maximum of thirteen (13) props and twelve (12) joist beams.

13. The formwork grid system of claim 12, wherein a grid size is eight feet by eight feet.

14. The formwork grid system of claim 13 wherein the formwork grid system supports a decking area of at least 94 feet by 23 feet.

15. A main beam formwork construction component, having a main beam profile comprising:

a lower horizontal support having a first end extending into a first clip area and a second end extending into a second clip area, wherein a cumulative width of the first clip area, the second clip area, and the lower horizontal support is greater than 10 centimeters;

a first angled support connected to the first clip area;

a second angled support connected to the second clip area, the first and second angled support extending linearly without bend and angling inward toward a center of the main beam profile;

a lower vertical support attached to, the lower horizontal support;

a bottom horizontal support at a base of the lower vertical support;

a first leg and a second leg attached to respective sides of the bottom horizontal support;

a first heel at a respective base of the first leg and the first angled support;

a second heel at a respective base of the second leg and the second angled support;

a top horizontal support of 10 centimeters or less in width, the top horizontal support including a first ear integral with a first end of the top horizontal support and a second ear integral with a second end of the top horizontal support;

a first upper vertical support attached at an inner side of the first ear at the first end of the top horizontal support and spanning between the top horizontal support and the lower horizontal support; and a second upper vertical support attached at an inner side of the second ear at the second end of the top horizontal support and spanning between the top horizontal support and the lower horizontal support, wherein the inner perimeter of the first heel, second heel, first leg, second leg, and bottom horizontal support form a lower cavity T-slot for the main beam profile.

16. The main beam formwork construction component of claim 15, the main beam profile further comprising:

a first pair of reinforced joints, each of the first pair of reinforced joints at a respective base of each of the first upper vertical support and the second upper vertical support.

17. The main beam formwork construction component of claim 15, wherein the main beam profile maintains interoperable external dimensions.

18. The main beam formwork construction component of claim 15, wherein the main beam profile has an external dimension of less than 6.4 inches in height and 5.8 inches in width.

* * * * *